US011173411B2

(12) United States Patent
Badie et al.

(10) Patent No.: US 11,173,411 B2
(45) **Date of Patent: *Nov. 16, 2021**

(54) DUAL BODY CONVERTIBLE TOY WITH FLEXIBLE BOTTOM EDGE

(71) Applicant: TEE TURTLE, LLC, Hazelwood, MO (US)

(72) Inventors: Ramy Adly Badie, High Ridge, MO (US); Charles Gaines, Jr., Denver, CO (US)

(73) Assignee: Tee Turtle, LLC, Hazelwood, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/422,260

(22) Filed: May 24, 2019

(65) Prior Publication Data

US 2019/0275437 A1 Sep. 12, 2019

Related U.S. Application Data

(63) Continuation-in-part of application No. 15/849,493, filed on Dec. 20, 2017, now Pat. No. 10,786,746.

(51) Int. Cl.
*A63H 3/36* (2006.01)
*A63H 3/02* (2006.01)

(52) U.S. Cl.
CPC ..... *A63H 3/365* (2013.01); *A63H 3/02* (2013.01)

(58) Field of Classification Search
CPC ..... A63H 33/004; A63H 3/003; A63H 3/02; A63H 3/12; A63H 33/003; A63H 33/00;
(Continued)

(56) References Cited

U.S. PATENT DOCUMENTS 1,111,659 A * 9/1914 Le Pierre
2,325,750 A 8/1943 Vries
(Continued)

FOREIGN PATENT DOCUMENTS

AU 2018102170 A4 7/2019
CN 303711656 S * 6/2016

OTHER PUBLICATIONS

Youtube, "DIY Viral Reversible Plushieii! Owl & Penguin Sock Plush Cute Budget Xmas Gift Ideas", https://www.youtube.com/watch?v=FOcQqA6Zhqg (Accessed: Jun. 19, 2019), Oct. 10, 2017, 3 pages (Year: 2017).*
(Continued)

*Primary Examiner* — Nini F Legesse
(74) *Attorney, Agent, or Firm* — Dorsey & Whitney LLP

(57) ABSTRACT

The present disclosure includes embodiments directed to a reversible toy. The reversible toy may include a body including first and second material layers coupled by a retainer. The body may define an opening to an interior cavity. The body may be reversible between a first position and a second position by collapsing at least a portion of the body through the opening. In the first position, the first material layer may form an outer surface of the reversible toy and the second material layer may form an inner surface of the reversible toy. The inner surface may define the interior cavity. In the second position, the second material layer may form the outer surface of the reversible toy and the first material layer may form the inner surface of the reversible toy. The retainer may define a bottom edge of the body in both the first and second positions.

20 Claims, 19 Drawing Sheets

(58) Field of Classification Search
CPC ..... A63H 3/14; A63H 3/365; A63H 17/02; A63H 33/088; A63H 3/16; A63H 3/46; A47G 9/1045; A42B 1/006; A45C 7/0077
USPC ..... 446/71–74, 321, 327, 594, 614
See application file for complete search history.

(56) References Cited

U.S. PATENT DOCUMENTS

D145,701 S 10/1946 Rodgers
D175,475 S * 8/1955 Oswald
2,844,912 A 7/1958 Sebesta
2,960,794 A 11/1960 Johns
D198,091 S 4/1964 Bonner
3,187,345 A * 6/1965 Holford
3,851,419 A 12/1974 Kaelin
3,864,871 A * 2/1975 Kaelin
4,107,873 A * 8/1978 Bauer ..... A63H 3/02 446/321
4,194,249 A * 3/1980 Thorneburg ..... A41B 11/003 2/239
4,268,918 A * 5/1981 Lee
D262,392 S 12/1981 Murasaki
4,304,065 A 12/1981 Baiera
4,341,096 A * 7/1982 Safrit ..... A41B 11/005 66/185
4,373,215 A * 2/1983 Guigley ..... D04B 1/26 2/239
D280,839 S 10/1985 Nihill
D284,056 S 6/1986 Kinsley
4,614,505 A 9/1986 Schneider et al.
D291,105 S 7/1987 Ehrenfried
4,695,264 A 9/1987 McLeod, Jr.
D294,724 S 3/1988 Lund
D297,251 S 8/1988 Gamazo-Canella
4,781,648 A 11/1988 Garfinkel
4,832,010 A * 5/1989 Lerman ..... A61F 2/7812 602/63
4,842,565 A 6/1989 VonPhilp, Sr.
4,850,927 A 7/1989 Caranica
D312,287 S 11/1990 Kolton
D316,734 S 5/1991 Tak
5,090,938 A 2/1992 Reynolds
D332,290 S 1/1993 Altiery
D334,954 S 4/1993 Calhoun
D342,557 S 12/1993 Frick
D343,874 S 2/1994 Messerli
D351,197 S * 10/1994 Vigneron
D369,632 S 5/1996 Wilke
5,649,848 A 7/1997 Clark
D390,285 S 2/1998 Conley et al.
D392,699 S 3/1998 Caldwell
D395,930 S 7/1998 Leadbetter
5,778,702 A 7/1998 Wrightenberry
D397,382 S 8/1998 Gensler
5,791,963 A 8/1998 Lieberman
D410,971 S 6/1999 Young
D413,637 S 9/1999 McLeer et al.
5,965,182 A 10/1999 Lindgren
D423,152 S 4/2000 Kelly
D424,256 S 5/2000 Lindgren
D438,271 S 2/2001 Wall
6,320,096 B1 * 11/2001 Inoue ..... A61F 13/51305 604/378
6,386,761 B1 * 5/2002 Bohnsack ..... A45C 3/00 383/24
D471,932 S 3/2003 Ravelo
6,645,101 B1 * 11/2003 Wong
D486,236 S 2/2004 Nan
D500,537 S 1/2005 Fong et al.
D505,290 S 5/2005 Bourget
D523,190 S 6/2006 Oblack
D546,906 S 7/2007 Aliaga
D556,393 S 11/2007 Rutherford et al.
D573,662 S 7/2008 Behn et al.
D621,885 S * 8/2010 Rappaport-Rowan
7,788,953 B1 9/2010 McMurray et al.
D627,526 S 11/2010 Hass
D634,372 S 3/2011 Garofalo
D654,969 S 2/2012 Gordon
D661,748 S 6/2012 Gordon
D665,614 S 8/2012 Lee
D673,408 S 1/2013 Randall
D714,881 S 10/2014 Michalowski et al.
D763,367 S 8/2016 Jamison
D768,245 S 10/2016 Matthews
D791,250 S 7/2017 Sielicka-Kalczynska
9,975,053 B1 * 5/2018 Sutton
10,786,746 B2 * 9/2020 Badie ..... A63H 3/02
2002/0162156 A1 * 11/2002 Clary
2007/0054593 A1 3/2007 Santos
2009/0205106 A1 * 8/2009 Sohn ..... A61F 5/0118 2/170
2012/0307010 A1 * 12/2012 Evertt ..... G06T 7/70 348/46
2014/0220851 A1 8/2014 Bennett
2014/0287648 A1 9/2014 Rebella et al.
2015/0314205 A1 11/2015 Rebella et al.
2017/0136375 A1 * 5/2017 Narayanan ..... A63H 3/12
2018/0020742 A1 * 1/2018 Johnson ..... A41B 11/005 2/239
2019/0184298 A1 * 6/2019 Badie ..... A63H 3/365
2019/0275436 A1 9/2019 Badie

OTHER PUBLICATIONS

Youtube, "Flip N Switch A Rooz Stuffed Plush Animals Turn Inside Out 2 in One Toys—Review Video Cookieswirlc", https://www.youtube.com/watch?v=jpOOPFLMQFk (Accessed: Jun. 19, 2019), Oct. 27, 2015, 3 pages (Year: 2015).*
Youtube, "DIY Viral Reversible Plushie!!! Owl & Penguin Sock Plush—Cute Budget Xmas Gift Ideas", https://www.youtube.com/watch?v=FOcQqA6Zhqg (Accessed: Jun. 19, 2019), 3 pages.
Youtube, "Flip N Switch A Rooz Stuffed Plush Animals Turn Inside Out 2 in One Toys—Review Video Cookieswirlc", https://www.youtube.com/watch?v=jpOOPFLMQFk (Accessed: Jun. 19, 2019), 3 pages.
IP Australia, "Second Examination Report of P268868.AU.01 dated Nov. 26, 2019", 5 pages.
MultiiMay, "DIY Reversible Octopus Plush", YouTube, https://www.youtube.com/watch?v=kec-kxN4Ka0, Sep. 14, 2017.
"Caltoy Inc Little Bo Peep and Sheep 2 in 1 Puppet", https://www.ebay.com/c/15017103118.
"Disney Parks Frozen Anna Elsa Flip 2 in 1 Topsy Turvy Reversible Plush Doll 15"", https://www.ebay.com/itm/Disney-Parks-Frozen-Anna-Elsa-Flip-2-in-1-Topsy-Turvy-Reversible-Plush-Doll-15/184072663574?hash=item2adb95f216:g:Bc4AAOSwG11d6q-e.
"Dole Discovery Channel Plush Brown Bear Reversible World Globe original tag 1999", https://www.ebay.com/itm/Dole-Discovery-Channel-Plush-Brown-Bear-Reversible-World-Globe-original-tag-1999-/202754209837.
"Used Jurassic World 11" Yellow Velociraptor raptor Dinosaur Plush Doll,Dino,Park", https://www.ebay.ca/itm/Used-Jurassic-World-11-Yellow-Velociraptor-raptor-Dinosaur-Plush-Doll-Dino-Park-/133397963351?oid=293528351983.
"Vintage Digimon AGUMON Evolving GREYMON 4" Plush Doll Figure YUTAKA Japan 1999", https://www.ebay.com/itm/Vintage-Digimon-AGUMON-Evolving-GREYMON-4-Plush-Doll-Figure-YUKATA-Japan-1999-/233212775092.
"Wild Republic Switch A Silly Fox and Owl 2 in 1 Plush Toy 7" 2014", https://www.ebay.com/itm/Wild-Republic-Switch-A-Silly-Fox-and-Owl-2-in-1-Plush-Toy-7-2014/333303407700?epid=1437462732&hash=item4d9a6e6454:g:J9gAAOSwcQVdXeEp.
Entertainment Earth, "Minecraft Reversible Plush Case", https://www.youtube.com/watch?v=ckV_by3kgtU, Feb. 25, 2015.
Kawaiipandacrafts, "Hello Kitty Reversible Plush-Turkey", https://www.youtube.com/watch?v=7tha3F86TY0, Dec. 27, 2012.
Mo's Chateau, "Switch A Rooz Dog/Cat Paws & Purrs Reversible Plush Toy—Demo", https://www.youtube.com/watch?v=u5taVw6S2U0, Feb. 28, 2015.

(56) References Cited

OTHER PUBLICATIONS

TTPM Toy Reviews, "Cut the Rope Reversible Plush-Sad/Box from Round 5", https://www.youtube.com/watch?v=bfcod92CzLA, Apr. 2, 2013.

TTPM Toy Reviews, "Transforming Plush from Disney", https://www.youtube.com/watch?v=MVmrocKi7Og, Mar. 23, 2011.

KellyToy Worldwide, Inc., and KellyToy (USA), Inc., Defendants, Case No. 2:20-cv-11301-MCS-MAA, "Defendant's Memorandom in Opposition to Plaintiff Tee Turtle, LLC's Motion for a Preliminary Injunction," filed Feb. 1, 2021, in U.S. District Court, Central District of California, Western Division, 30 pages.

KellyToy Worldwide, Inc., and KellyToy (USA), Inc., Defendants, Case No. 2:20-cv-11301-MCS-MAA, "Declaration of Laura Wilson in Support of Defendant's Opposition to Plaintiff Tee Turtle, LLC's Motion for a Preliminary Injuction," filed Feb. 1, 2021, in U.S. District Court, Central District of California, Western Division, 25 pages.

KellyToy Worldwide, Inc., and KellyToy (USA), Inc., Defendants, Case No. 2:20-cv-11301-MCS-MAA, Exhibits A though M of "Declaration of Laura Wilson in Support of Defendant's Opposition to Plaintiff Tee Turtle, LLC's Motion for a Preliminary Injuction," filed Feb. 1, 2021, in U.S. District Court, Central District of California, Western Division, 100 pages.

KellyToy Worldwide, Inc., and KellyToy (USA), Inc., Defendants, Case No. 2:20-cv-11301-MCS-MAA, Exhibits N though S of "Declaration of Laura Wilson in Support of Defendant's Opposition to Plaintiff Tee Turtle, LLC's Motion for a Preliminary Injuction," filed Feb. 1, 2021, in U.S. District Court, Central District of California, Western Division, 45 pages.

KellyToy Worldwide, Inc., and KellyToy (USA), Inc., Defendants, Case No. 2:20-cv-11301-MCS-MAA, Exhibit T of "Declaration of Laura Wilson in Support of Defendant's Opposition to Plaintiff Tee Turtle, LLC's Motion for a Preliminary Injuction," filed Feb. 1, 2021, in U.S. District Court, Central District of California, Western Division, 50 pages.

KellyToy Worldwide, Inc., and KellyToy (USA), Inc., Defendants, Case No. 2:20-cv-11301-MCS-MAA, "Declaration of Mark B. Mizrahi in Support of Defendent's Opposition to Plaintiff Tee Turtle, LLC's Motion for a Preliminary Injuction," and Exhibits 1 through 24, filed Feb. 1, 2021, in U.S. District Court, Central District of California, Western Division, 214 pages.

KellyToy Worldwide, Inc., and KellyToy (USA), Inc., Defendants, Case No. 2:20-cv-11301-MCS-MAA, Exhibits A though M of "Notice of Lodging Petition for Reexamination of U.S. Pat. No. 10,786,746," filed Feb. 11, 2021, in U.S. District Court, Central District of California, Western Division, 213 pages.

KellyToy Worldwide, Inc., and KellyToy (USA), Inc., Defendants, Case No. 2:20-cv-11301-MCS-MAA, Exhibits A though M of "Exhibit D to Notice of Lodging Petition for Reexamination of U.S. Pat. No. 10,786,746," filed Feb. 11, 2021, in U.S. District Court, Central District of California, Western Division in U.S., 3 pages.

* cited by examiner

DUAL BODY CONVERTIBLE TOY WITH FLEXIBLE BOTTOM EDGE

CROSS REFERENCE TO RELATED APPLICATIONS

This application is a continuation-in-part of U.S. patent application Ser. No. 15/849,493, filed Dec. 20, 2017 and entitled "REVERSIBLE TOY," which is related to U.S. Design patent application No. 29/630,400, filed Dec. 20, 2017 and entitled "REVERSIBLE PLUSH TOY," which issued as U.S. Design Pat. No. D822,127 on Jul. 3, 2018, which are both hereby incorporated by reference herein in their entireties for all purposes.

TECHNICAL FIELD

The technology disclosed herein relates generally to toys, and more specifically to a reversible plush toy.

BACKGROUND

Toys adapted to convert from one configuration to another are known in the art and cover a wide range of toys from mechanical robots that convert into vehicles to soft dolls that convert between differing configurations. For example, some traditional configurations include portions that selectively interlock with each other in alternative arrangements.

Although there are a variety of toys that provide some transition, it is important to have a toy that can be easily and quickly reversed between positions to present different appearances or configurations.

The information included in this Background section of the specification is included for technical reference purposes only and is not to be regarded subject matter by which the scope of the present disclosure is to be bound.

SUMMARY

The present disclosure provides a reversible toy, as described below and defined in the accompanying claims. The reversible toy may include a body including opposing first and second surfaces. The body may be reversible between first and second positions to alternatingly present the first and second surfaces as an outer body surface defining an exterior of the body. The other of the first and second surfaces may alternatingly define a stored body surface defining an interior cavity within the body. The reversible toy may include an opening to the interior cavity defined by the body and having a diameter. At least portions of the body may collapse through the opening when the body is moved between the first and second positions. The reversible toy may include a retainer defining the diameter of the opening. The diameter of the opening may be smaller than a maximum diameter of the body to retain a shape of the body as the body switches between the first and second positions.

Embodiments of the present disclosure may also include a reversible plush toy. The reversible plush toy may include a hollow body defined by opposing first and second surfaces and reversible between first and second positions. Each of the first and second positions of the body may include an outer body surface and a stored body surface. The outer body surface may define an exterior of the body. The stored body surface may define an interior cavity within the body. The reversible plush toy may include an opening to the interior cavity defined by the body. At least portions of the first and second surfaces may collapse through the opening when the body is moved between the first and second positions. In the first position, the first surface may define the outer body surface and the second surface may define the interior cavity within the body. In the second position, the second surface may define the outer body surface and the first surface may define the interior cavity within the body.

Embodiments of the present disclosure may also include a method of reversing a plush toy. The method may include defining first and second opposing surface of a body of the toy, defining an opening through the body, and passing at least portions of the body through the opening to alternatingly present the first surface or the second surface as an exterior of the body. The other of the first surface or the second surface may alternatingly collapse within the body to define an interior cavity within the body. The diameter of the opening may be smaller than a maximum diameter of the body.

Embodiments of the present disclosure may also include a reversible toy. The reversible toy may include a body including first and second material layers coupled by a retainer. The body may define an opening to an interior cavity. The body may be reversible between a first position and a second position by collapsing at least a portion of the body through the opening. In the first position, the first material layer may form an outer surface of the reversible toy and the second material layer may form an inner surface of the reversible toy. The inner surface may define the interior cavity. In the second position, the second material layer may form the outer surface of the reversible toy and the first material layer may form the inner surface of the reversible toy. The retainer may define a bottom edge of the body in both the first and second positions.

Embodiments of the present disclosure may also include a reversible toy. The reversible toy may include a body including a first surface and a second surface opposing the first surface. The body may be reversible between first and second positions. An opening to an interior cavity may be defined by the body and may have a diameter adjustable between a first dimension and a second dimension when the body is moved between the first and second positions. In the first position, the first surface may define an outer body surface and the second surface may define an inner body surface. In the second position, the second surface may define the outer body surface and the first surface may define the inner body surface. The body may define the same shape in both the first position and the second position.

Embodiments of the present disclosure may also include a reversible toy. The reversible toy may include a first body configuration and a second body configuration. The first body configuration may include a first body outer surface defining a first body perimeter, a first body inner surface defining an interior cavity, and a first body undulating bottom edge. The second body configuration may include a second body outer surface, a second body inner surface, and a second body undulating bottom edge. The second body outer surface may be the first body inner surface and the second body outer surface may define a second body perimeter. The second body inner surface may be the first body outer surface and the second body inner surface may define the interior cavity. The first body perimeter may have the same dimensions as the second body perimeter. The first body undulating bottom edge and the second body undulating bottom edge may form the same bottom edge of the reversible toy. The reversible toy may be transitioned from the first body configuration to the second body configuration at least in part by pushing the first body outer surface towards the first body inner surface.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present disclosure as defined in the claims is provided in the following written description of various embodiments of the claimed subject matter and illustrated in the accompanying drawings.

DETAILED DESCRIPTION

Figure 1:
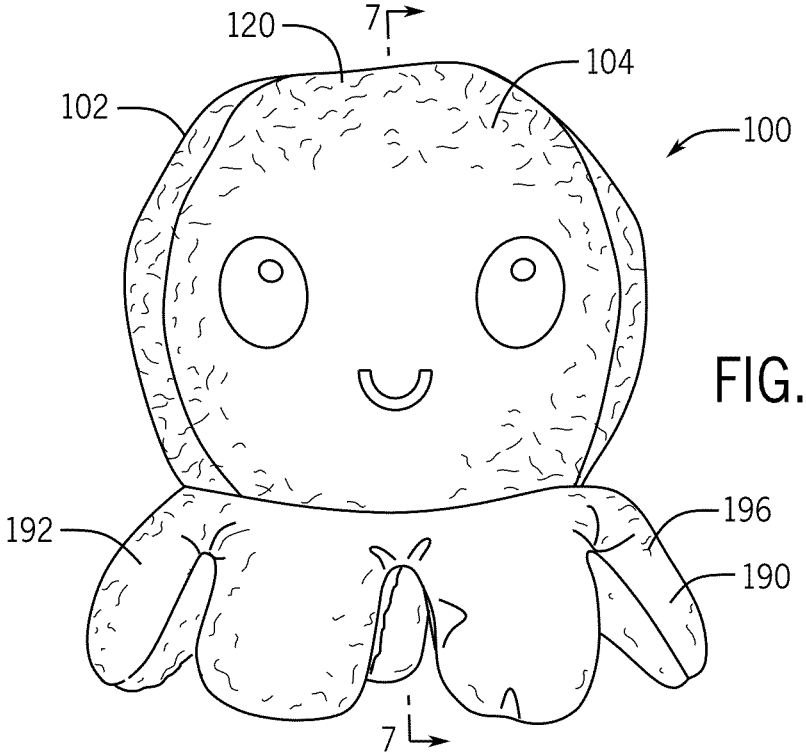
FIG. 1 is an isometric view of a reversible toy in a first orientation according to one embodiment of the present disclosure.

The present disclosure relates to a toy reversible or convertible between positions to alternatingly present different portions or faces of the toy as an exterior surface thereof. In one example, the toy includes a body defining an interior cavity. As the toy is reversed between positions, the surface of the body defining the interior cavity may be switched to at least partially define an exterior surface of the body. At or about the same time, the surface of the body defining the exterior surface of the body may be switched to at least partially define the interior cavity of the body. In this manner, the reversible toy may permit a user to alternatingly present a desired surface of the toy as a visible surface and store or position an opposing surface at least partially within the body. In one example, the body shapes are the same, but the materials defining the two body shapes are different colors or patterns from one another and/or include different aesthetic elements (e.g., sewn or glued facial elements) that correspond to opposing emotions, e.g., happy and angry or sad. In this manner, the toy can allow users to visually define his or her mood, such as by switching the toy between the desired body shape.

The toy may include an opening to the interior cavity, the opening having a diameter or width defining an expanse between opposing sides of the opening. In such embodiments, at least portions of the body may collapse through the opening when the body is moved between positions to alternatingly present different portions or faces of the toy as an exterior surface thereof. In some embodiments, the toy may include a retainer, such as a retaining ring, stitched edge, or other structure, defining or setting the diameter of the opening. The retaining element may include a perimeter that defines the perimeter of the opening as well. The diameter of the opening may be defined or restrained by the retainer to allow selective collapsing of the body through the opening while also retaining a shape of the body in each position. For example, the diameter of the opening may be smaller than a maximum diameter of the body to limit undesired collapsing of the body through the opening to retain a shape of the body in each position.

In some embodiments, the toy may include one or more appendages attached to the body to better simulate an animal or human character. Like the hollow body, the appendages may be reversed between positions to alternatingly present different surfaces or sides of the appendages as an exterior surface thereof. The appendages may be reversible with the body. For example, the appendages may be reversed between positions contemporaneously with movement of the body between positions.

In some embodiments, the retainer may have some flexibility. For example, the retainer may define an edge or perimeter of the opening and include sufficient flexibility, such as by having an edge length that is longer than a bottom perimeter boundary of the body, allowing the opening to more easily enlarge as the body switches between positions to alternatingly present different portions or faces of the toy as an exterior surface thereof. For example, the opening may be stretched to form an opening width or diameter that is greater than a width or diameter of the body to more easily push at least portions of the body through the at least partially widened opening. As one example, the retainer may be defined by an undulating edge or seam that includes additional length edges that do not directly extend around the perimeter, such as extending up towards the top end of the body and back down towards the bottom edge. These additional lengths help to impart flexibility to the retainer, allowing the retainer to be more easily stretched and extended, increasing the opening.

Figure 2:
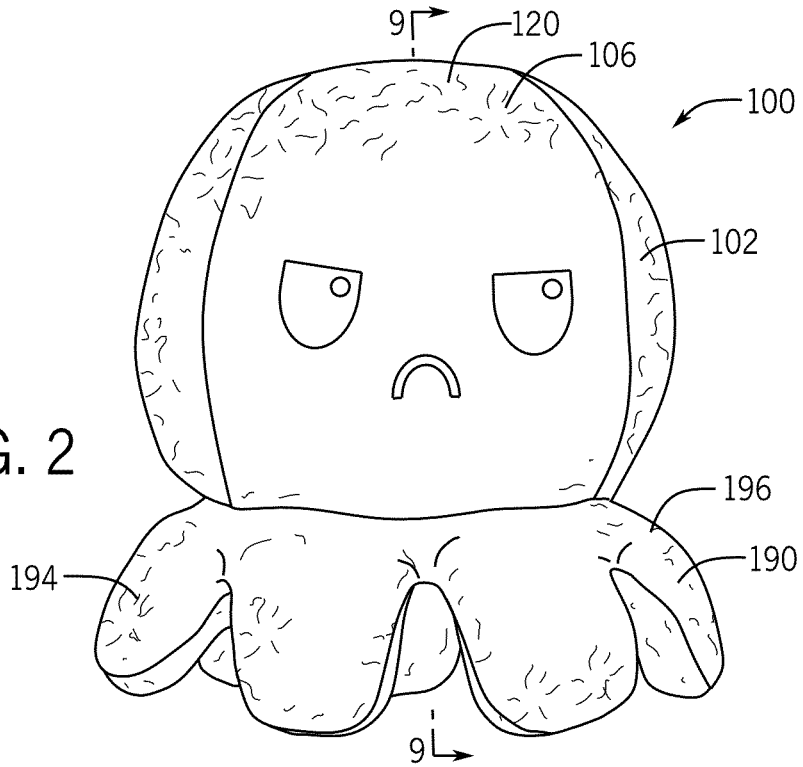
FIG. 2 is an isometric view of the reversible toy in a second orientation according to one embodiment of the present disclosure.
Figure 3:
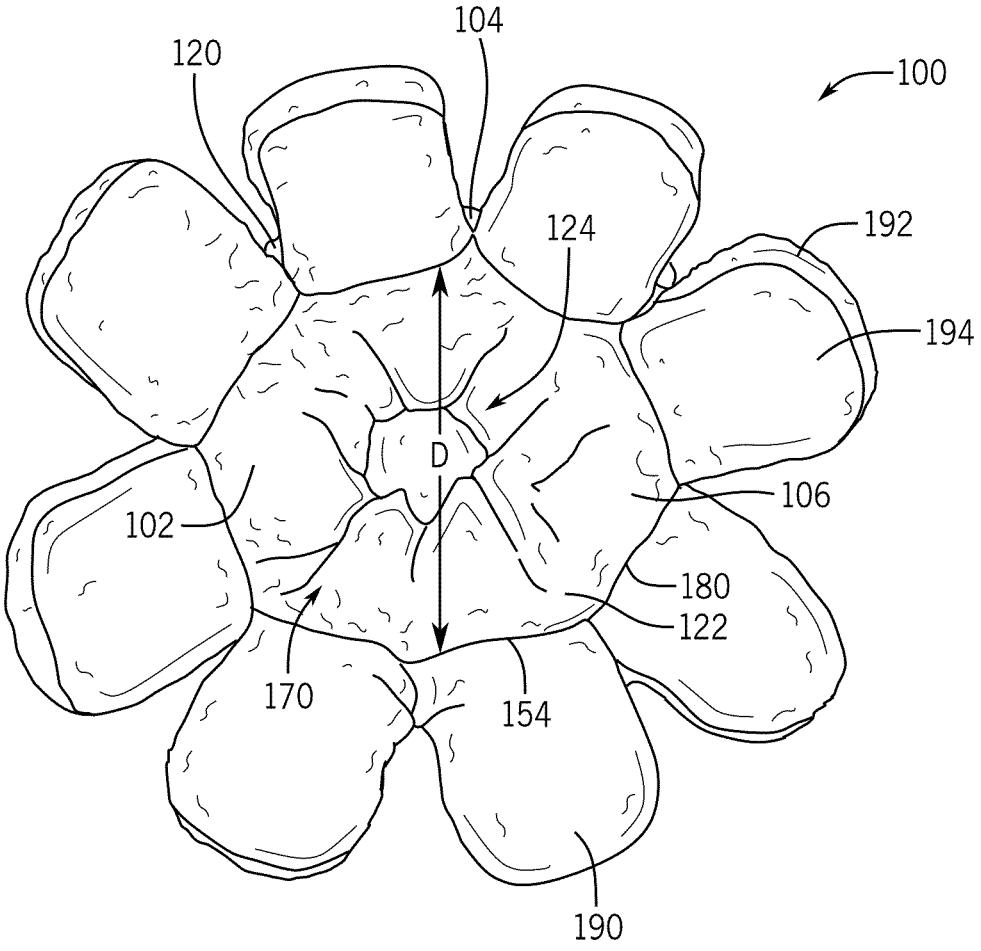
FIG. 3 is another isometric view of the reversible toy in the first orientation.

Turning to the figures, illustrative embodiments of the present disclosure will now be discussed in more detail. FIG. 1 is an isometric view of a reversible toy 100 in a first orientation. FIG. 2 is an isometric view of the reversible toy 100 in a second orientation. FIG. 3 is another isometric view of the reversible toy 100 in the first orientation. Referring to FIGS. 1-3, the reversible toy 100 includes a hollow body 102 defined by or including opposing first and second surfaces 104, 106. The first and second surfaces 104, 106 may extend on opposing sides of the body 102, such as generally parallel to each other, in a spaced apart relationship, or any combination thereof. The body 102 may define all or a portion of the reversible toy 100. For instance, the reversible toy 100 may be defined entirely by the body 102, or the body 102 may define only a part of the reversible toy 100, such as a head portion, a body portion, an arm portion, and/or a leg portion of the reversible toy 100, among others. In this manner, the body 102 may define the core or central portion of the reversible toy 100, with other portions of the reversible toy 100, if any, being minor appendages thereto.

As explained more fully below, the body 102 is reversible between first and second positions. For example, the body 102 may be moved between the first and second positions to alternatingly present different configurations or characteristics of the body 102. The different configurations or characteristics of the body 102 may be selected for aesthetic reasons. For example, reversing the body 102 between the first and second positions may present differing aesthetic properties of the reversible toy 100. Depending on the particular embodiment, the first and second positions may present the same or different configurations or characteristics of the body 102. For instance, the first position of the body 102 may present a first configuration or characteristic of the body 102 (see FIG. 1). The first configuration or characteristic of the body 102 may be a first facial expression, a first color combination, a first body shape, or a first tactile feel, among others, or any combination thereof. The second position of the body 102 may present a second configuration or characteristic of the body 102 (see FIG. 2). The second configuration or characteristic of the body 102 may be a second facial expression, a second color combination, a second body shape, or a second tactile feel, among others, or any combination thereof. Depending on the particular application, the first and second positions may differ in at least one characteristic. For example, the first and second positions may differ in one characteristic (e.g., facial expression only), two characteristics (e.g., facial expression and color), three characteristics (e.g., facial expression, color, and tactile feel), etc., or in all or substantially all characteristics. Though illustrated as presenting different visible or physical characteristics between the first and second positions, in some embodiments, the first and second positions may be identical or substantially identical to each other. In such embodiments, the arrangement of the reversible toy 100 may allow the body 102 to reverse between positions while still maintaining the same or generally the same characteristics between the first and second positions.

With continued reference to FIGS. 1-3, in each of the first and second positions, the body 102 includes an outer body surface 120 defining an exterior of the body 102 and a stored body surface 122 defining an interior cavity 124 within the body 102. As described herein, the body 102 is reversible between the first and second positions to alternatingly present the first and second surfaces 104, 106 as the outer body surface 120 defining the exterior of the body 102. In such embodiments, the other of the first and second surfaces 104, 106 alternatingly defines the stored body surface 122 defining the interior cavity 124 within the body 102 as the body 102 is reversed between positions. For instance, in the first position of the body 102, the first surface 104 may define the outer body surface 120 defining the exterior of the body 102, with the second surface 106 defining the stored body surface 122 defining the interior cavity 124 within the body 102. Similarly, in the second position of the body 102, the second surface 106 may define the outer body surface 120 defining the exterior of the body 102, with the first surface 104 defining the stored body surface 122 defining the interior cavity 124 within the body 102. In some embodiments, the outer body surface 120 may be sized and shaped such that the stored body surface 122 is positioned entirely or substantially entirely within the interior cavity 124 of the body 102. In this manner, the stored body surface 122 may be concealed from view in each of the first and second positions of the body 102. Alternatively, the stored body surface 122 may be visible from limited perspectives, such as from only a bottom perspective view or similar. For example, as shown in FIG. 3, the stored body surface 122 remains visible from a bottom view of the toy 100, in other words, the stored body surface 122 may not be sealed or closed such that it is easily accessible to a user.

Figure 4:
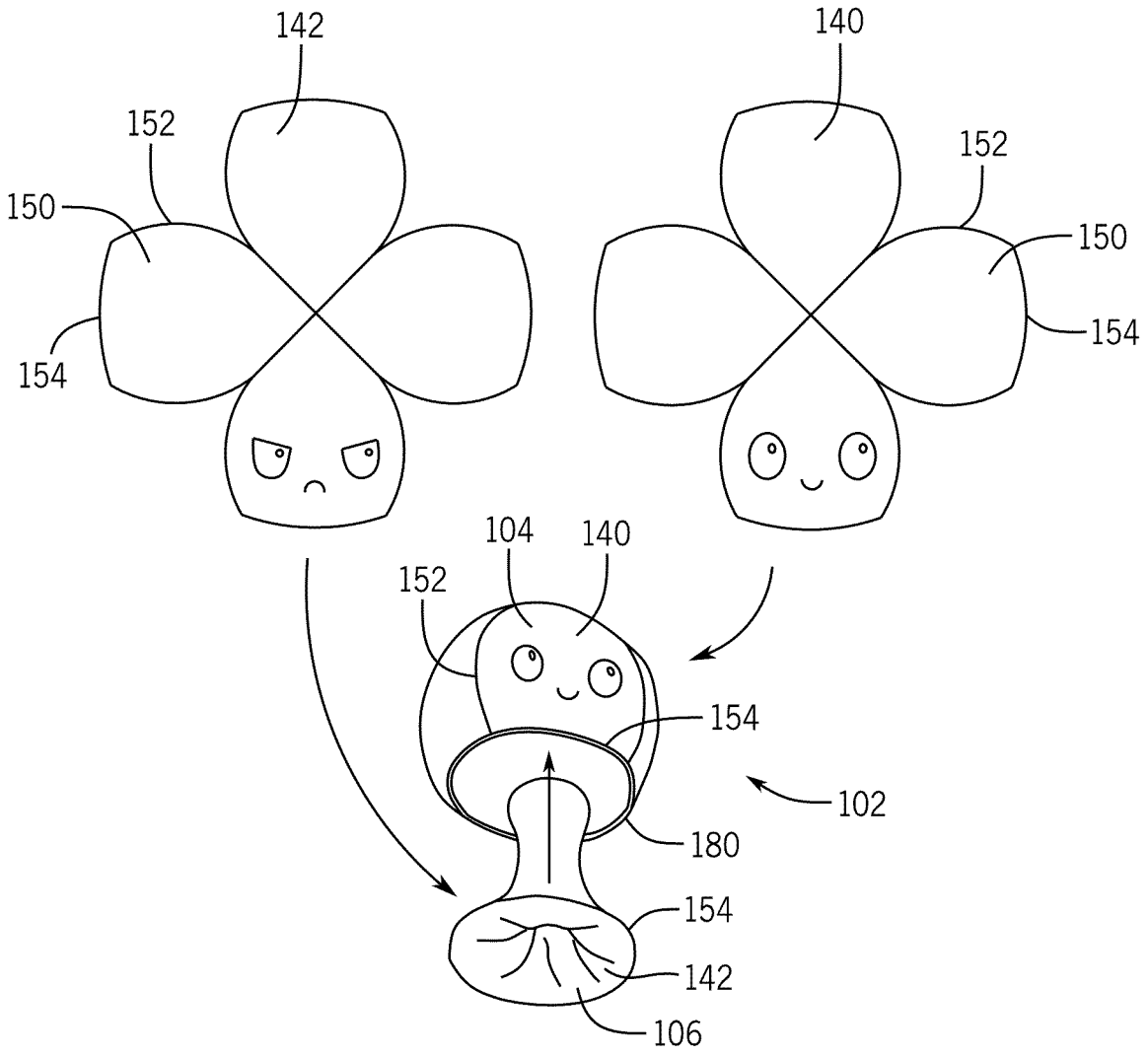
FIG. 4 is an exploded view of a body portion of the reversible toy according to one embodiment of the present disclosure.

FIG. 4 is an exploded view of the body 102 according to one embodiment of the present disclosure. As shown in FIG. 4, the body 102 may include a first material layer 140 and a second material layer 142. In such embodiments, the first material layer 140 may define the first surface 104. Similarly, the second material layer 142 may define the second surface 106. Depending on the particular application, the body 102 may include fill material 144 positioned between the first and second material layers 140, 142 (see FIG. 7). For example, soft stuffing material may be positioned between the first and second material layers 140, 142 to provide a soft feel or plushness to the reversible toy 100. The fill material 144 may allow the first and second material layers 140, 142 to move relative to each other as the body 102 switches between the first and second positions. For example, the fill material 144 may allow the first and second material layers 140, 142 to slide relative to each other, compress towards or expand away from each other, or any combination thereof to facilitate movement of the body 102 between positions.

The first and second material layers 140, 142 may be flexible to facilitate movement of the body 102 between positions. For instance, the first and second material layers 140, 142 may be formed at least partially from fabric sheets or material, as explained below. The first and second material layers 140, 142 may be formed from identical or different materials or fabrics. For example, the material or fabric of the first and second material layers 140, 142 may be chosen to provide a same or differing characteristic of the first and second positions of the body 102. More specifically, the material or fabric of the first material layer 140 may be chosen to provide a first characteristic of the body 102 (e.g., a first color and/or tactile feel). In like manner, the material or fabric of the second material layer 142 may be chosen to provide a second characteristic of the body 102 (e.g., a second color and/or tactile feel).

With continued reference to FIG. 4, the body 102 may include a plurality of sections or portions coupled together. In one embodiment, as shown in FIG. 4, each of the first and second material layers 140, 142 may include a plurality of body portions 150 coupled together. The body portions 150 may be arranged to provide a desired size and shape of the body 102 once the body portions 150 are coupled together. For example, the body portions 150 may be sized and shaped such that when coupled together the body portions 150 define a globoid shape to the body 102, though other shapes are contemplated including cylindrical, ellipsoid, etc. As shown in FIG. 4, each body portion may include one or more side edges 152 and a terminal edge 154. In such embodiments, at least portions of the one or more side edges 152 of one body portion may be attached to the side edges 152 of an adjacent body portion, such as by stitching. As explained more fully below, the terminal edges 154 may be arranged to couple the first material layer 140 to the second material layer 142. For example, the terminal edges 154 of the first material layer 140 may be stitched to the terminal edges 154 of the second material layer 142 to connect the first and second material layers 140, 142 together. In some embodiments, the first and second material layers 140, 142 may be connected together only at the terminal edges 154. Alternatively, the first and second material layers 140, 142 may be connected together at other positions, whether in combination with the connection at the terminal edges 154 or not. Though FIG. 4 illustrates the body 102 formed from a plurality of material layers connected together, in some embodiments, the body 102 may be formed from a single material layer for easier assembly and/or reduced manufacturing costs. The body portions 150 may be sized and shaped as desired. For instance, the body portions 150 may be symmetrical about a longitudinal axis, include a tapering width along their lengths, or otherwise.

Referring to FIG. 3, the reversible toy 100 includes an opening 170 to the interior cavity 124. As shown, the opening 170 may be defined by the body 102, such as by the terminal edges 154 of the body portions 150. As described herein, at least portions of the body 102 collapse through the opening 170 when the body 102 is moved between the first and second positions. For example, as detailed more fully below, at least portions of the first and second surfaces 104, 106 collapse through the opening 170 to alternatingly present one of the first and second surfaces 104, 106 as the outer body surface 120 and the other of the first and second surfaces 104, 106 as the stored body surface 122 within the interior cavity 124. As shown in FIG. 3, the opening 170 includes a diameter D. The diameter D of the opening 170 may be defined or restrained to allow collapsing of the first and second surfaces 104, 106 therethrough while also retaining a shape of the body 102 as the body 102 switches between the first and second positions. For example, the diameter D of the opening 170 may be large enough to allow collapsing of the first and second surfaces 104, 106 of the body 102 therethrough as the body 102 is moved between positions. Additionally or alternatively, the diameter D of the opening 170 may be smaller than a maximum diameter $D_{MAX}$ of the body 102 to retain a shape of the body 102 in each of the first and second positions (see FIGS. 7 and 9). For instance, the diameter D of the opening 170 may be smaller than a maximum diameter $D_{MAX}$ of the body 102 to limit undesired collapsing of the body 102 through the opening 170 to facilitate an upstanding position of the body 102.

Referring to FIGS. 3 and 4, the reversible toy 100 may include a retainer 180 defining the diameter D of the opening 170. The retainer 180 may be substantially any element or structure operable to set or determine the diameter D of the opening 170. Depending on the particular application, the retainer 180 may be a separate element connected to the body 102 or may be defined as part of the body 102 itself. As one example, the retainer 180 may be a ring positioned adjacent to the opening 170. The ring may include many configurations. For example, as shown in FIGS. 3 and 4, the ring may be defined as a line of stitching. Alternatively, the ring may be plastic or metal, among others. In one example, the retainer 180 may be defined by the length of the terminal edges 154. More specifically, the total length of the terminal edges 154 may be less than a maximum circumference of the body 102 to define the diameter D of the opening 170 smaller than a maximum diameter $D_{MAX}$ of the body 102.

Figure 5:
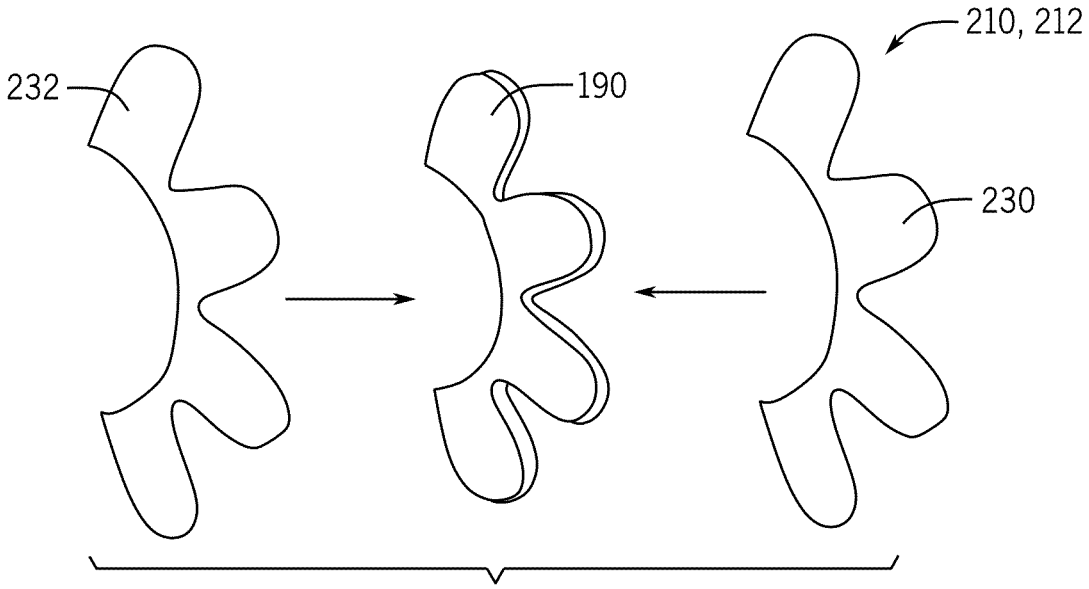
FIG. 5 is an exploded view of an appendage portion of the reversible toy according to one embodiment of the present disclosure.

FIG. 5 is an exploded view of an appendage assembly of the reversible toy 100 according to one embodiment of the present disclosure. Referring to FIGS. 1-3 and 5, the reversible toy 100 may include one or more appendages 190 attached to the body 102. As shown, the appendages 190 may include opposing first and second sides 192, 194. As explained below, the appendages 190 may be moved between positions to alternatingly present the first side 192 or the second side 194 as an exterior surface 196 of the appendages 190. In such embodiments, the exterior surface 196 of the appendages 190 may correspond with the outer body surface 120 of the body 102. For example, in one position of the appendages 190, the first side 192 of the appendages 190 may define the exterior surface 196 of the appendages 190 when the first surface 104 of the body 102 defines the outer body surface 120 of the body 102. In like manner, in another position of the appendages 190, the second side 194 of the appendages 190 may define the exterior surface 196 of the appendages 190 when the second surface 106 of the body 102 defines the outer body surface 120 of the body 102.

In one embodiment, the appendages 190 may be reversible with the body 102 to alternatingly present different configurations or characteristics of the appendages 190. For example, the appendages 190 may be reversible between first and second configurations corresponding to the first and second positions of the body 102. Like the first and second positions of the body 102, the first and second configurations of the appendages 190 may present the same or different configurations or characteristics of the appendages 190. For instance, the first configuration of the appendages 190 may present a first characteristic of the appendages 190. The first characteristic of the appendages 190 may be a first color combination, a first shape, or a first tactile feel, among others, or any combination thereof. The second configuration of the appendages 190 may present a second characteristic of the appendages 190. The second characteristic of the appendages 190 may be a second color combination, a second shape, or a second tactile feel, among others, or any combination thereof. The first and second configurations of the appendages 190 may differ in at least one characteristic, such as color, visual appearance, or tactile feel.

The appendages 190 may be arranged in many suitable configurations. For example, the appendages 190 may be defined by first and second portions 210, 212 connected together. The first and second portions 210, 212 may be identical or substantially identical to each other. In some embodiments, the first and second portions 210, 212 may be mirror images of each other. Depending on the particular application, at least one of the first and second portions 210, 212 may include more than one appendage 190. For example, the first portion 210 may include a first set of appendages 220. The first set of appendages 220 may include one appendage 190, two appendages 190, three appendages 190, four appendages 190, or more than four appendages 190. The second portion 212 may include a second set of appendages 222. Like the first set of appendages 220, the second set of appendages 222 may include one appendage 190, two appendages 190, three appendages 190, four appendages 190, or more than four appendages 190. The first portion 210 may include the same number of appendages 190 or a different number of appendages 190 compared to the second portion 212. For instance, the first portion 210 may include a greater number of appendages 190, the same number of appendages 190, or a lesser number of appendages 190 than the second portion 212.

Referring to FIG. 5, the first and second portions 210, 212 may each include first and second layers 230, 232 connected together. In such embodiments, the first layer 230 may define the first side 192 of the appendages 190. Similarly, the second layer 232 may define the second side 194 of the appendages 190. In some embodiments, fill material 234 (e.g., soft stuffing material) may be positioned between the first and second layers 230, 232 (see FIG. 7). The fill material 234 within the appendages 190 may provide a soft feel or plushness to the reversible toy 100. Additionally or alternatively, the fill material 234 within the appendages 190 may provide a three-dimensional depth or shape to the appendages 190. Like the first and second material layers 140, 142 of the body 102, the first and second layers 230, 232 of the appendages 190 may be formed at least partially from fabric sheets or material. The first and second layers 230, 232 may be formed from identical or different materials or fabrics. For example, the material or fabric of the first layer 230 may be chosen to provide a same or differing characteristic of the material or fabric of the second layer 232.

Figure 6:
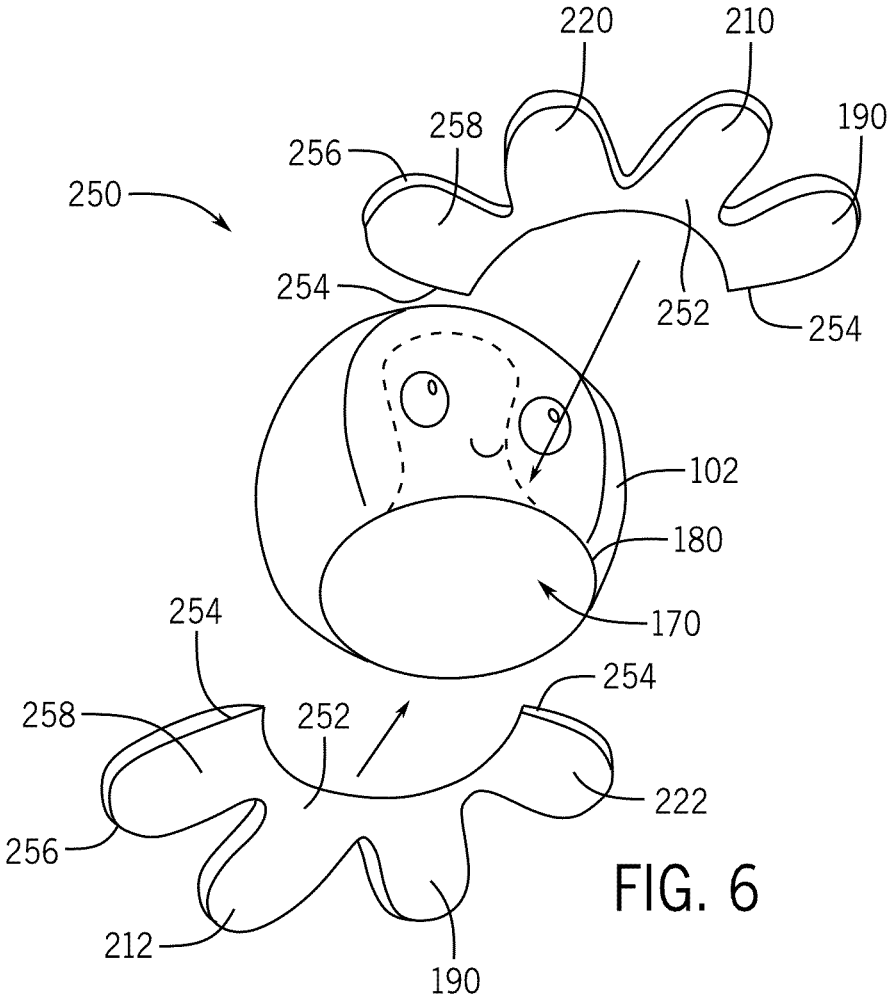
FIG. 6 is an exploded view of the reversible toy of FIG. 1 and showing the connection between the body portion of FIG. 4 and the appendage portion of FIG. 5.

FIG. 6 is an exploded view of the reversible toy 100 showing the connection between the body 102 and the appendages 190. Referring to FIG. 6, the first and second portions 210, 212 may be connected together to define an appendage assembly 250. As shown, each of the first and second portions 210, 212 may include a central body 252 with the one or more appendages 190 extending therefrom. The central body 252 may include opposing ends 254. In such embodiments, the opposing ends 254 of the first portion 210 may be connected to the opposing ends 254 of the second portion 212 to define the appendage assembly 250 extending around the body 102. As shown, the central body 252 of each of the first and second portions 210, 212 may be curved along its length to match the circular shape of the opening 170. In such embodiments, the appendages 190 may extend radially away from the central body 252. In one embodiment, the appendages 190 may be radially spaced from one another, with distal portions 256 of the appendages 190 spaced further apart from one another than proximal portions 258 of the appendages 190. In one embodiment, the appendages 190 may be spaced equidistantly from one another in a radial arrangement. Though the figures illustrate the first and second portions 210, 212 connected together to define the appendage assembly 250, in some embodiments the first and second portions 210, 212 may be spaced from each other. In this manner, the appendage assembly 250 may be defined by one or more discrete elements, whether connected together or otherwise.

As shown in FIG. 6, the appendage assembly 250 may be connected to the body 102 to define the reversible toy 100. The appendage assembly 250 may be connected to the body 102 in many suitable manners. As one example, the appendage assembly 250 may be attached to the body 102 by the retainer 180, though other configurations are contemplated. For example, the appendage assembly 250 may be attached to the body 102 independent from the retainer 180, such as via a line of stitching separate from the retainer 180. Depending on the desired characteristics of the reversible toy 100, the appendage assembly 250 may be attached to the body 102 adjacent to the opening 170. In such embodiments, the appendages 190 may conceal or otherwise hide the opening 170 from view from one or more perspectives.

Figure 7:
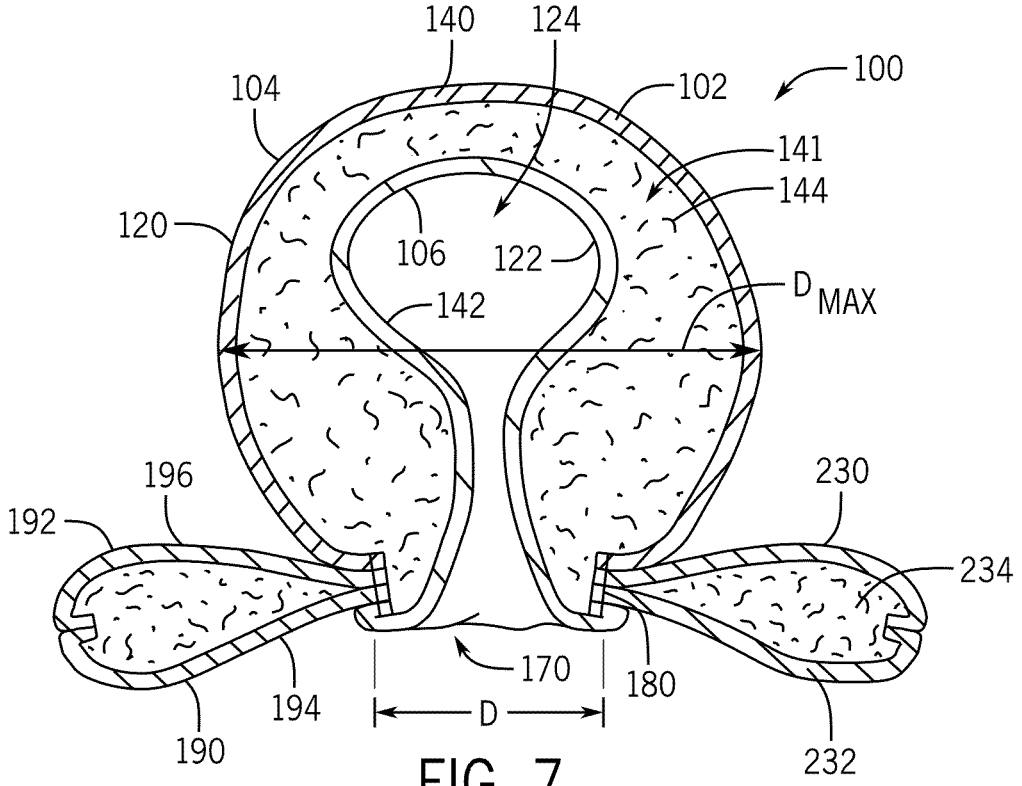
FIG. 7 is a cross-sectional view of the reversible toy in the first orientation and taken along line 7-7 of FIG. 1.
Figure 8:
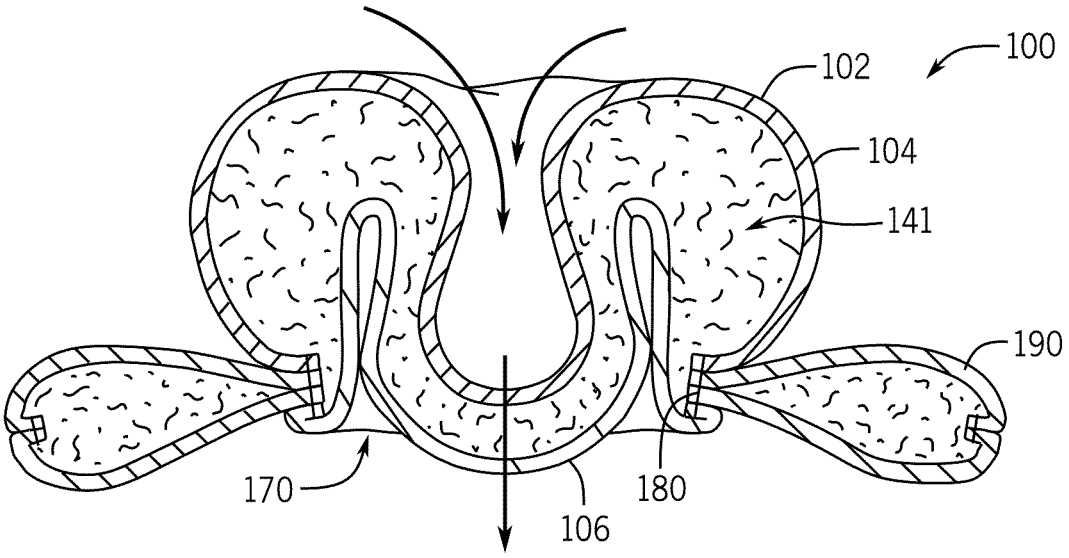
FIG. 8 is a cross-sectional view of the reversible toy being moved from the first orientation to the second orientation.
Figure 9:
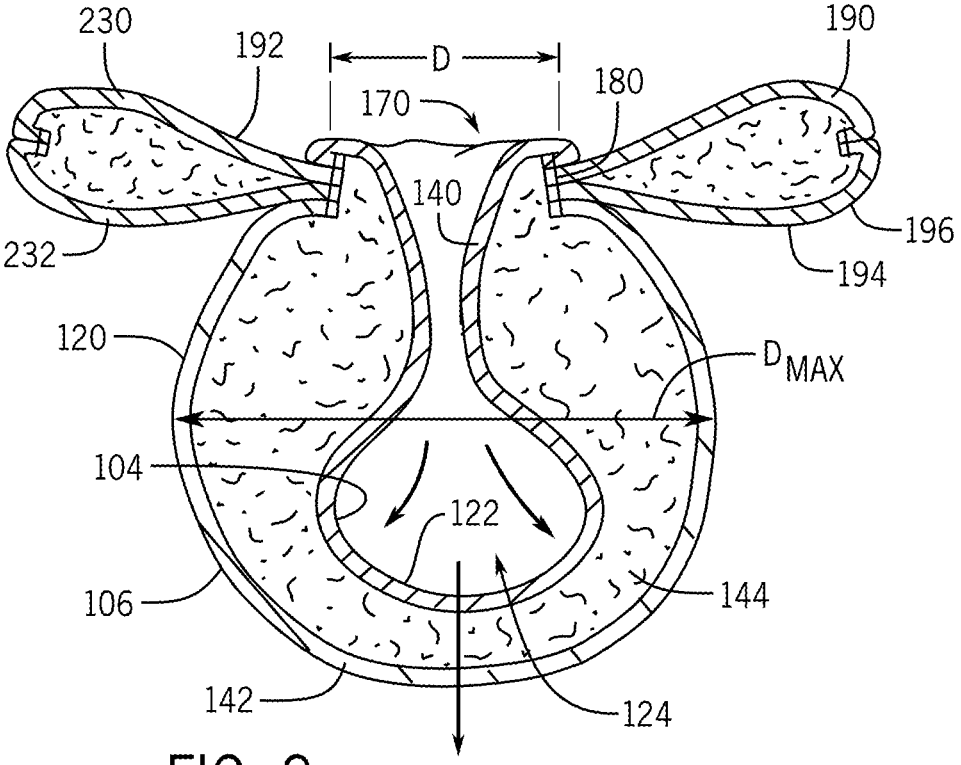
FIG. 9 is a cross-sectional view of the reversible toy in the second orientation and taken along line 9-9 of FIG. 2.
Figure 10:
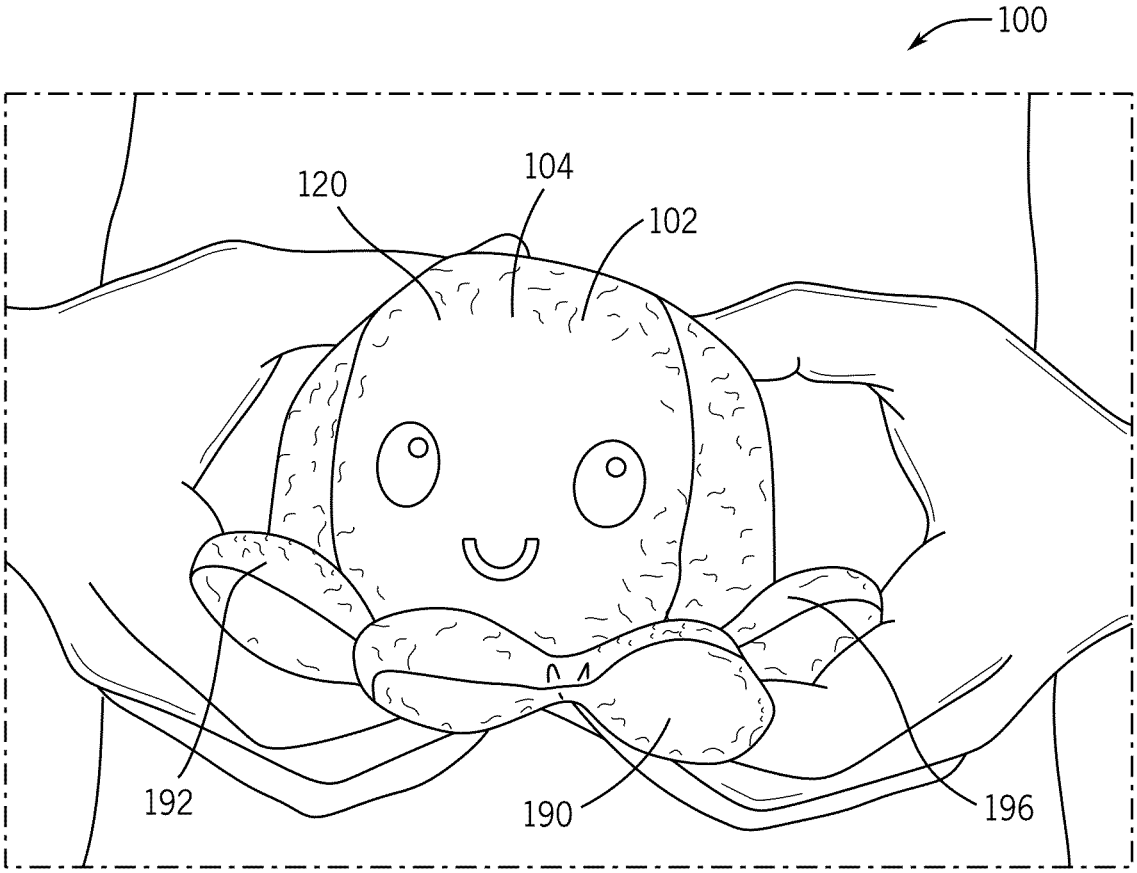
FIG. 10 a perspective view of the reversible toy in the first orientation.
Figure 11:
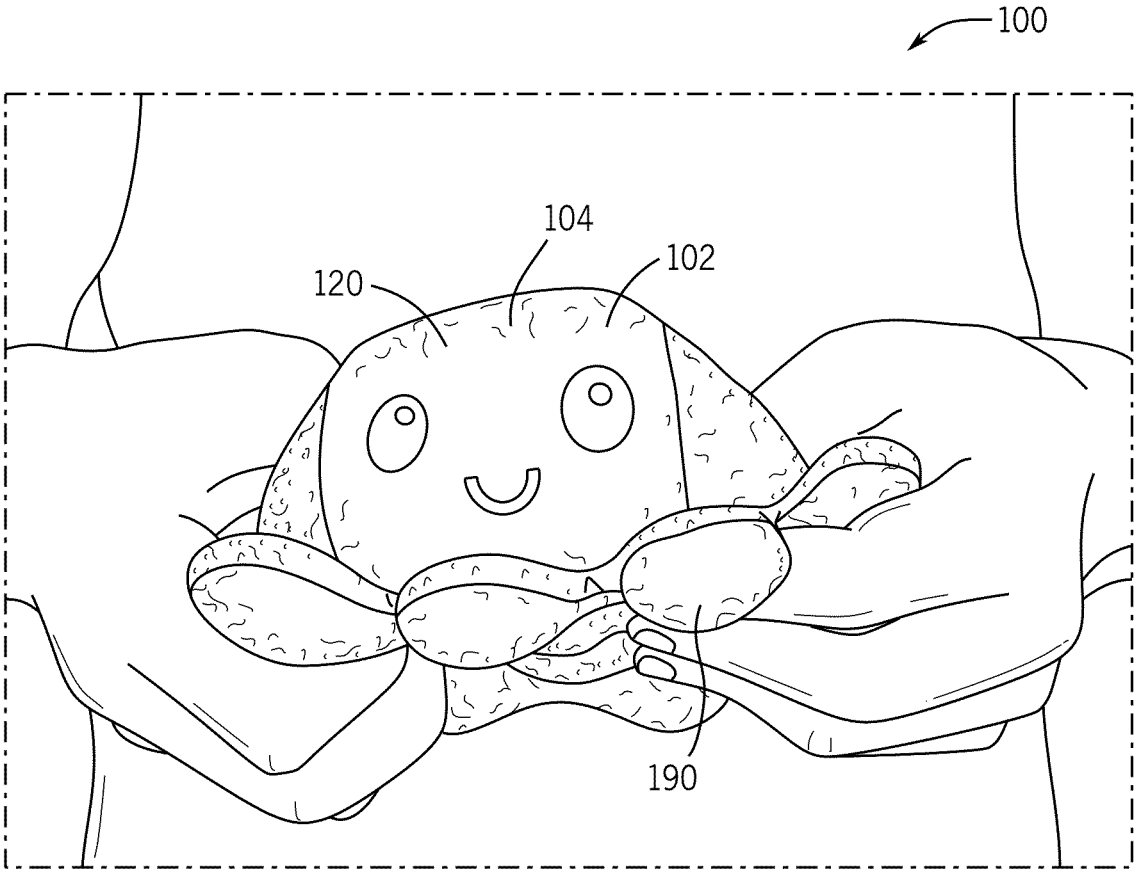
FIG. 11 is a perspective view of the reversible toy being moved from the first orientation to the second orientation.
Figure 12:
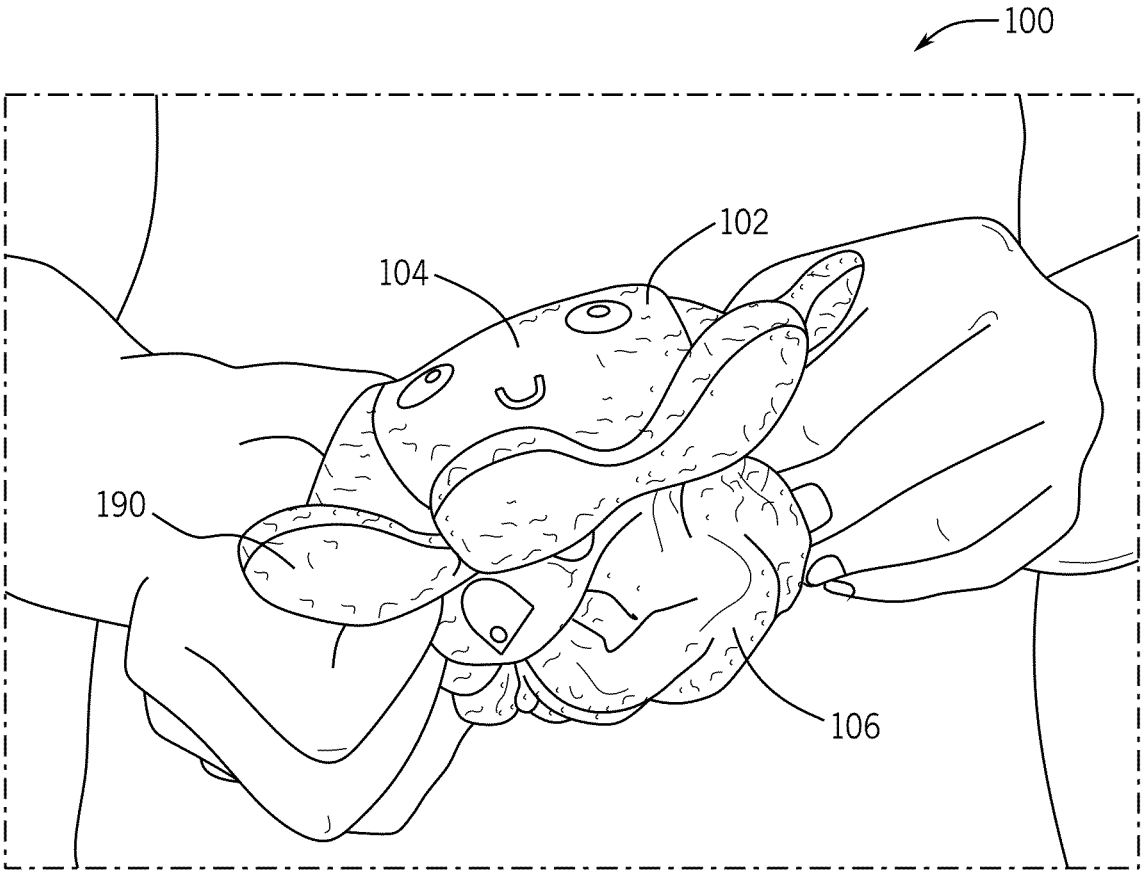
FIG. 12 is another perspective view of the reversible toy being moved from the first orientation to the second orientation and showing a portion of the body being collapsed through an opening of the body.
Figure 13:
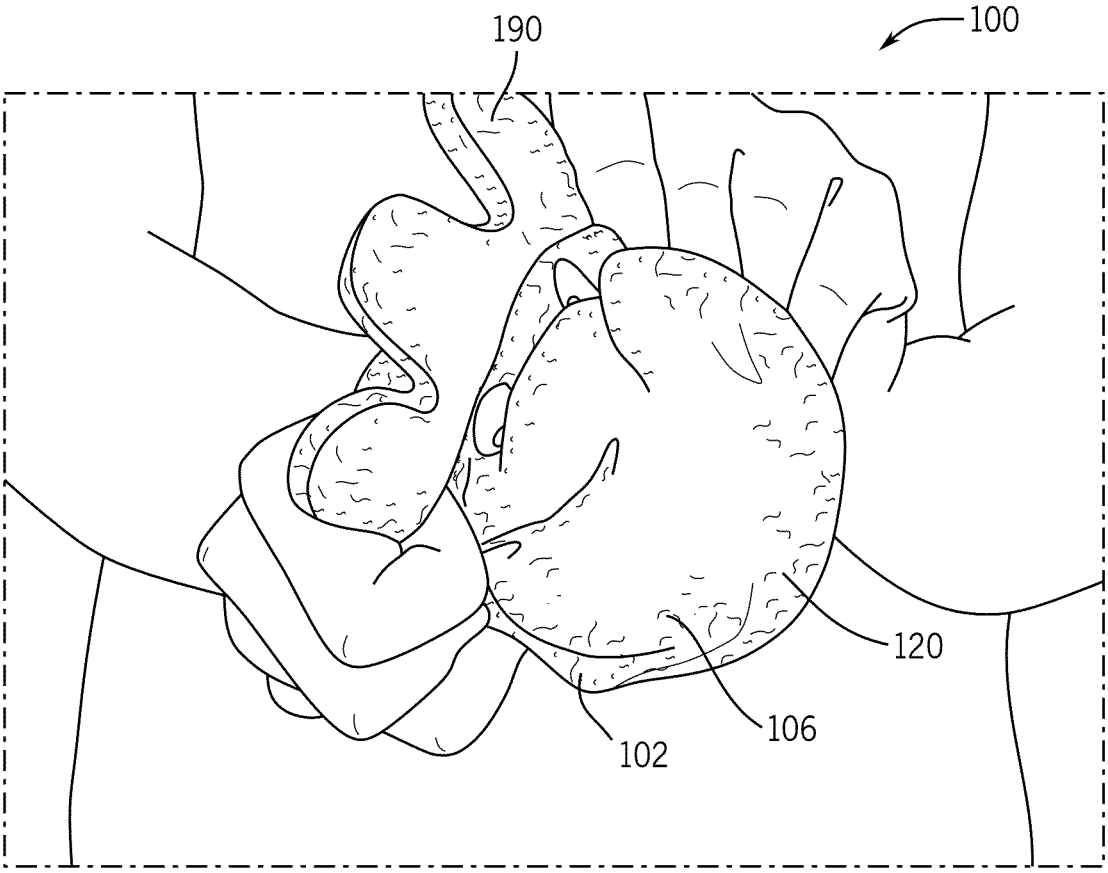
FIG. 13 is another perspective view of the reversible toy being moved from the first orientation to the second orientation and showing a portion of the body being further collapsed through the opening.
Figure 14:
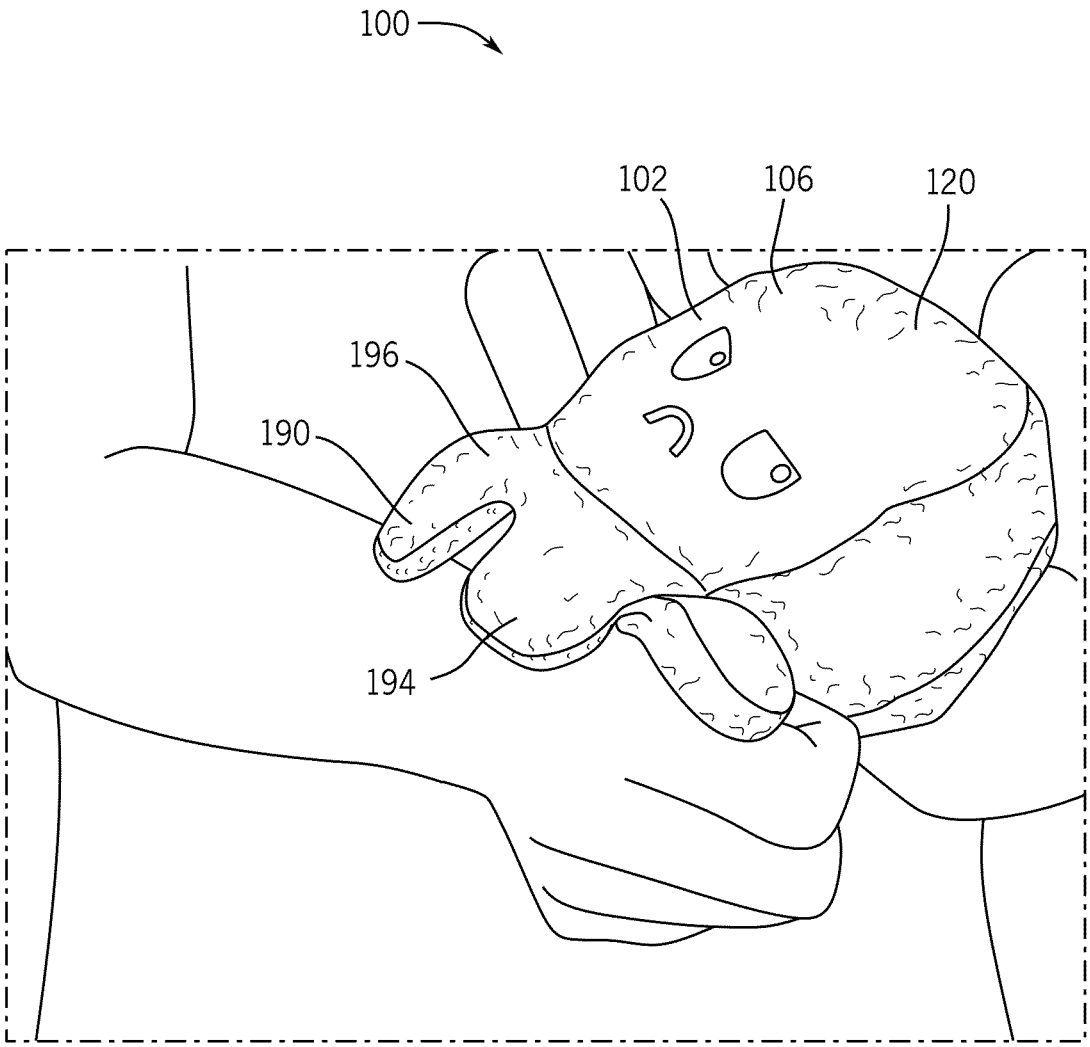
FIG. 14 is a perspective view of the reversible toy in the second orientation.

As described herein, the appendages 190 in combination with the body 102 may combine to simulate an animal or human character, whether real, legendary, or fictional. For instance, the body 102 of the reversible toy 100 may simulate a head and/or body portion of an animal or human character. In such embodiments, the appendages 190 may simulate legs, arms, tentacles, horns, ears, hair, or other body appendages of an animal or human character. As one example, FIGS. 1-3 illustrate the reversible toy 100 simulating an octopus, though other configurations are contemplated. For example, the body 102 and appendages 190 may combine to simulate a turtle, a narwhal, a dragon, a bunny, a unicorn, a panda, a penguin, a puppy, or a cat, among others. In some embodiments, the appendages 190 may be attached to the body 102 such that the appendages 190 are visible in only one of the first and second orientations of the reversible toy 100. For example, the appendages 190 may be attached to the first material layer 140 such that the appendages 190 are visible only when the body 102 is positioned in its first position. In such examples, the appendages 190 may be positioned within the interior cavity 124 when the body 102 is moved to its second position. In some embodiments, the appendages 190 may be omitted from the reversible toy 100, and only the body 102 itself may simulate the animal or human character FIG. 7 is a cross-sectional view of the reversible toy 100 in the first orientation. FIG. 8 is a cross-sectional view of the reversible toy 100 being moved from the first orientation to the second orientation. FIG. 9 is a cross-sectional view of the reversible toy 100 in the second orientation. FIG. 10 is a perspective view of the reversible toy 100 in the first orientation. FIG. 11 is a perspective view of the reversible toy 100 being moved from the first orientation to the second orientation. FIG. 12 is another perspective view of the reversible toy 100 being moved from the first orientation to the second orientation and showing a portion of the body 102 being collapsed through the opening 170. FIG. 13 is another perspective view of the reversible toy 100 being moved from the first orientation to the second orientation and showing the body 102 further collapsed through the opening 170. FIG. 14 is a perspective view of the reversible toy 100 in the second orientation. Referring to FIGS. 7 and 10, the reversible toy 100 may be positioned in a first orientation in which the body 102 is positioned in its first position, as described above. Depending on the particular application, the appendages 190 may also be positioned in their first configuration when the reversible toy 100 is positioned in the first orientation. In the first orientation shown in FIGS. 7 and 10, the first surface 104 of the body 102 may define the outer body surface 120 thereof. Additionally, the first side 192 of the appendages 190 may define the exterior surface 196 thereof. As shown in FIG. 7, the second surface 106 of the body 102 may define the stored body surface 122 defining the interior cavity 124 within the body 102 when the reversible toy 100 is positioned in the first orientation.

The reversible toy 100 may be moved to a second orientation as desired. For example, at any point of operation or play, the reversible toy 100 may be moved from its first orientation to a second orientation reversing the orientations of the body 102 and/or appendages 190. Referring to FIGS. 8 and 11-13, to move the reversible toy 100 from the first orientation to the second orientation, the body 102 may be at least partially collapsed through the opening 170 to reverse the orientations of the first and second surfaces 104, 106 of the body 102. More specifically, at least portions of the body 102 may be pushed, pulled, or otherwise collapsed through the opening 170 by a user to reverse the orientations of the first and second surfaces 104, 106. As shown in FIGS. 9 and 14, once the body 102 is sufficiently collapsed through the opening 170, the reversible toy 100 may be positioned in the second orientation in which the body 102 is positioned in its second position, as described above. Depending on the particular application, the appendages 190 may also be positioned in their second configuration when the reversible toy 100 is positioned in the second orientation. In the second orientation shown in FIGS. 9 and 14, the second surface 106 of the body 102 may define the outer body surface 120 thereof. Additionally, the second side 194 of the appendages 190 may define the exterior surface 196 thereof. As shown in FIG. 9, the first surface 104 of the body 102 may define the stored body surface 122 defining the interior cavity 124 within the body 102 when the reversible toy 100 is positioned in the second orientation.

The reversible toy 100 may be moved back to its first orientation as desired. Moving the reversible toy 100 from the second orientation to the first orientation may be accomplished in reverse order from that described above. For example, the body 102 may be at least partially collapsed through the opening 170 to reverse the orientations of the first and second surfaces 104, 106 such that the body 102 is positioned in its first position and/or the appendages 190 are positioned in their first configuration. The reversible toy 100 may be reversed as desired. For example, a user may reverse the reversible toy 100 as desired for play, fun, amusement, or otherwise.

Depending on the particular application, the appendages 190 may or may not be collapsed through the opening 170 when the reversible toy 100 is moved between the first and second orientations. For example, depending on the particular animal or human character simulated by the reversible toy 100, the appendages 190 may be positioned such that movement of the body 102 between positions does not collapse the appendages 190 through the opening 170 (see FIGS. 7-14). In other embodiments, however, the appendages 190 may be attached to the body 102 such that movement of the body 102 between positions collapses the appendages 190 through the opening 170 to position the appendages 190 within the interior cavity 124 within the body 102, or vice versa.

Figure 15:
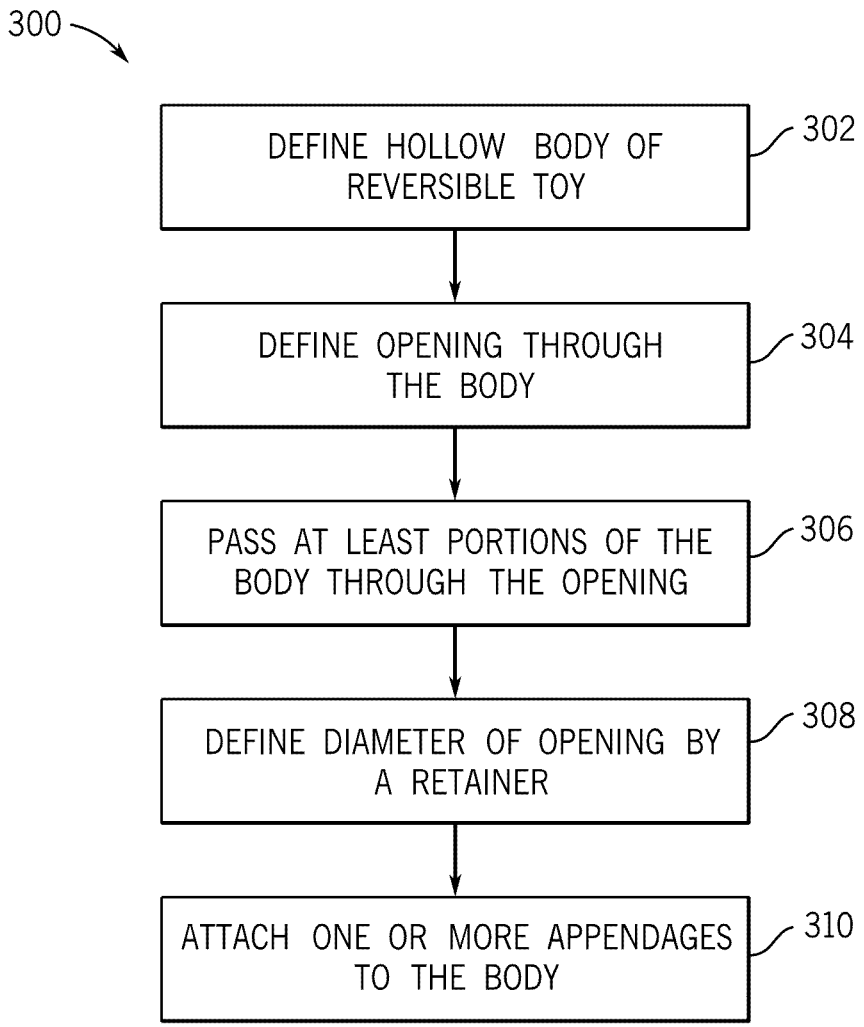
FIG. 15 is a flow chart illustrating a method of reversing a reversible toy according to one embodiment of the present disclosure.

FIG. 15 is a flow chart illustrating a method 300 of reversing a plush toy, such as reversible toy 100. Referring to FIG. 15, the method 300 includes defining the body 102 of the reversible toy 100 (Block 302), defining the opening 170 through the body 102 (Block 304), and passing at least portions of the body 102 through the opening 170 (Block 306). The body 102 may include first and second surfaces 104, 106. The diameter D of the opening 170 may be smaller than a maximum diameter $D_{Max}$ of the body 102. Passing portions of the body 102 through the opening 170 may alternatingly present the first surface 104 or the second surface 106 as an exterior of the body 102 (e.g., as the outer body surface 120). The other of the first surface 104 or the second surface 106 may be alternatingly collapsed within the body 102, such as within the interior cavity 124 of the body 102. In some embodiments, defining the body 102 may include attaching a plurality of body portions 150 together. Attachment of the plurality of body portions 150 may define the shape of the body 102. For example, attaching the body portions 150 together may define a globoid-type shape to the body 102, though other shapes are contemplated.

With continued reference to FIG. 15, the method 300 may include defining the diameter D of the opening 170 by the retainer 180 (Block 308). For example, as noted above, the retainer 180 may be a line of stitching or other structure arranged to limit expansion of the opening 170.

In some embodiments, the method 300 may include attaching one or more appendages 190 to the body 102 (Block 310). For instance, the one or more appendages 190 may be attached to the body 102 adjacent to the opening 170. In one embodiment, the one or more appendages 190 may be attached to the body 102 at the opening 170. Attachment of the one or more appendages 190 to the body 102 may define the diameter D of the opening 170.

Figure 16:
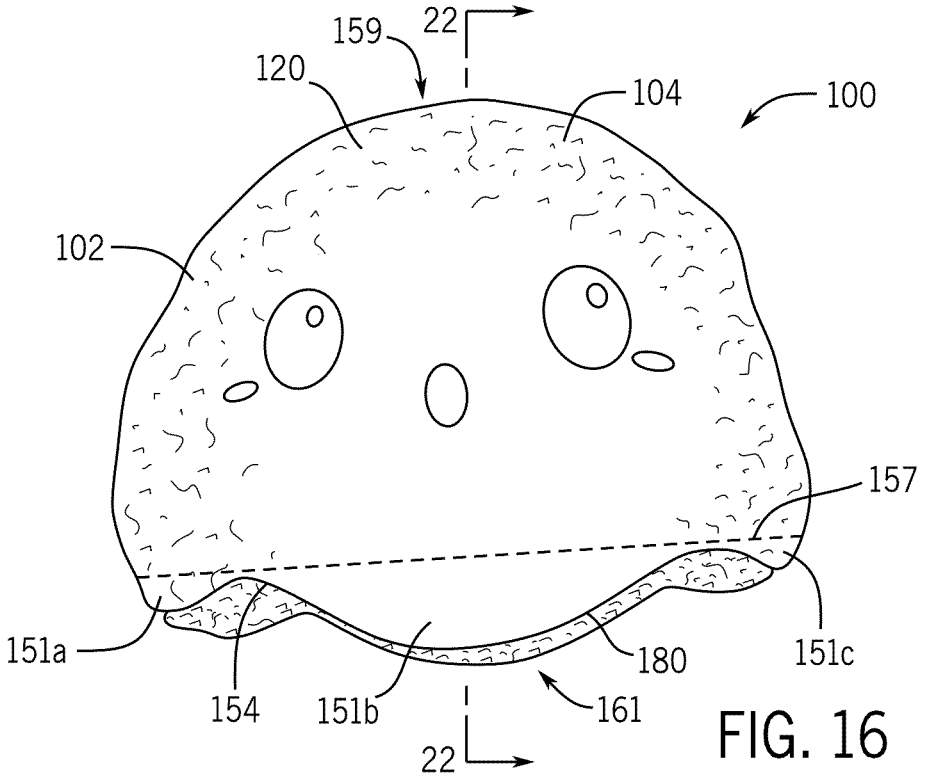
FIG. 16 is an isometric view of a reversible toy in a first orientation according to another embodiment of the present disclosure.
Figure 17:
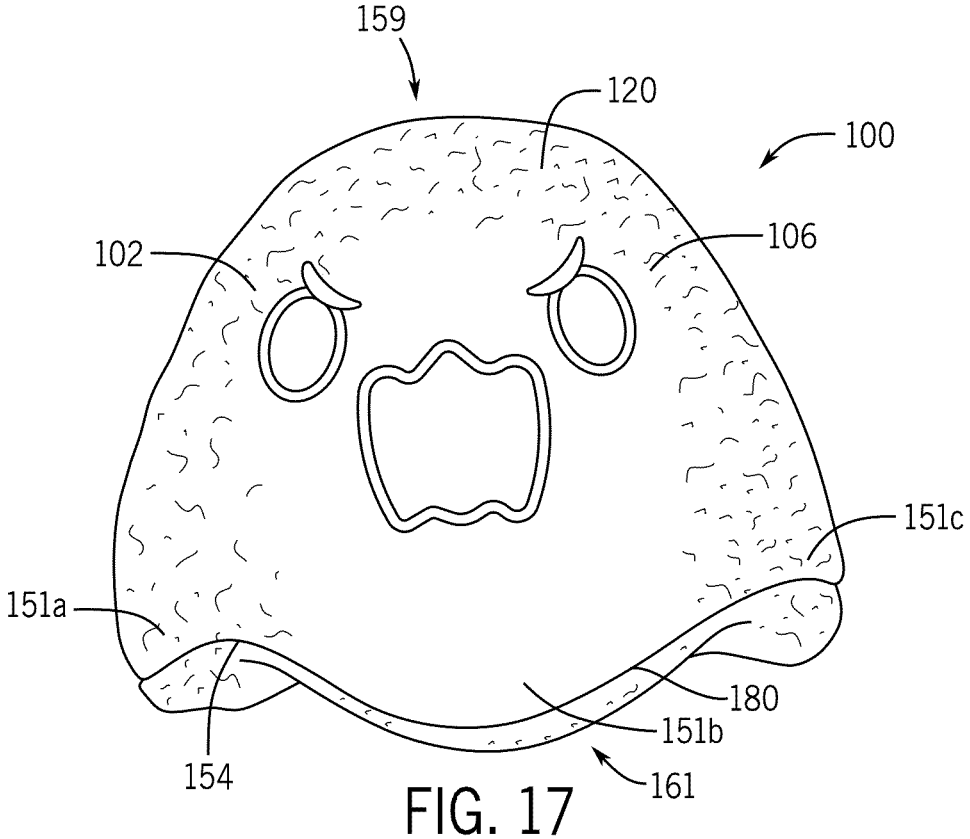
FIG. 17 is an isometric view of the reversible toy of FIG. 16 in a second orientation.
Figure 19:
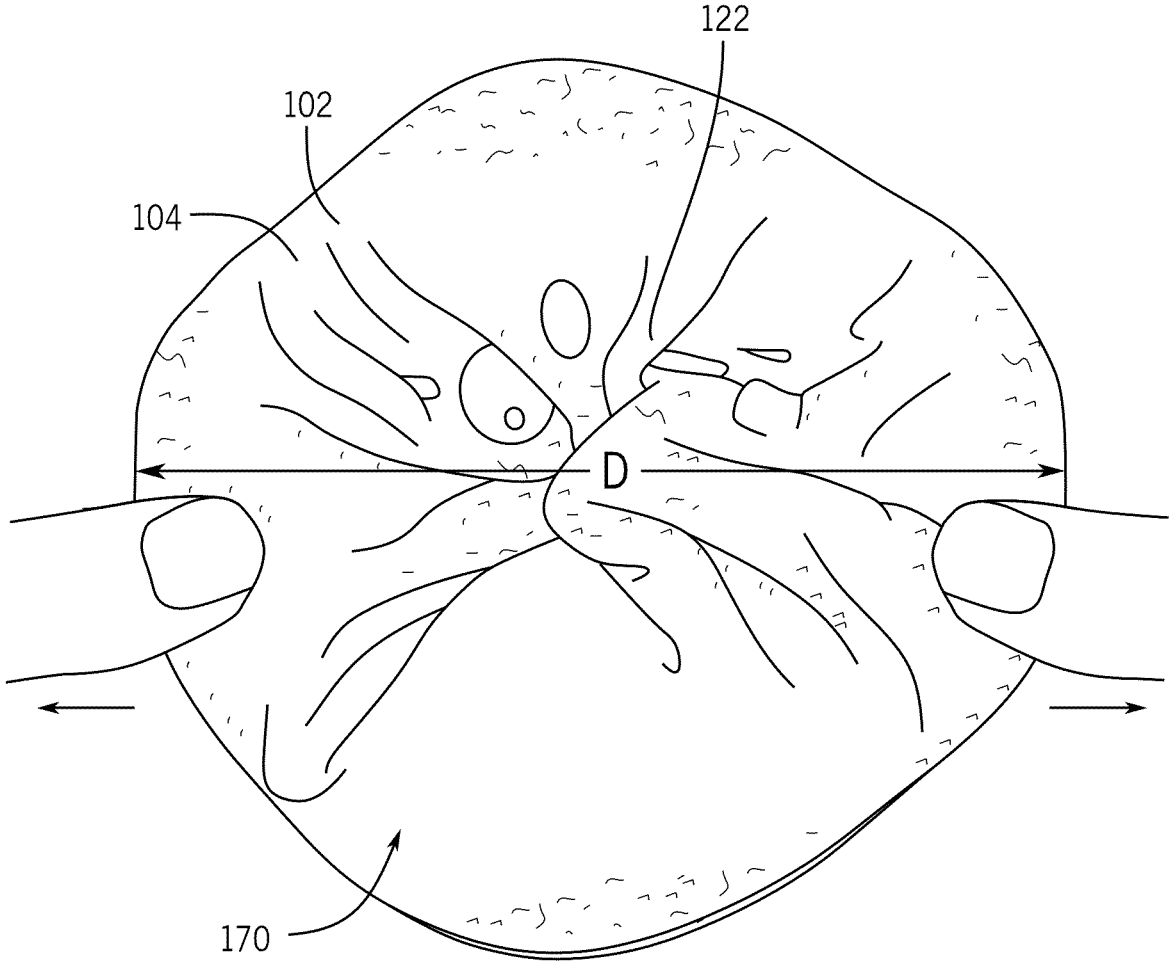
FIG. 19 is a bottom plan view of the reversible toy of FIG. 16 in a second or expanded position.
Figure 20:
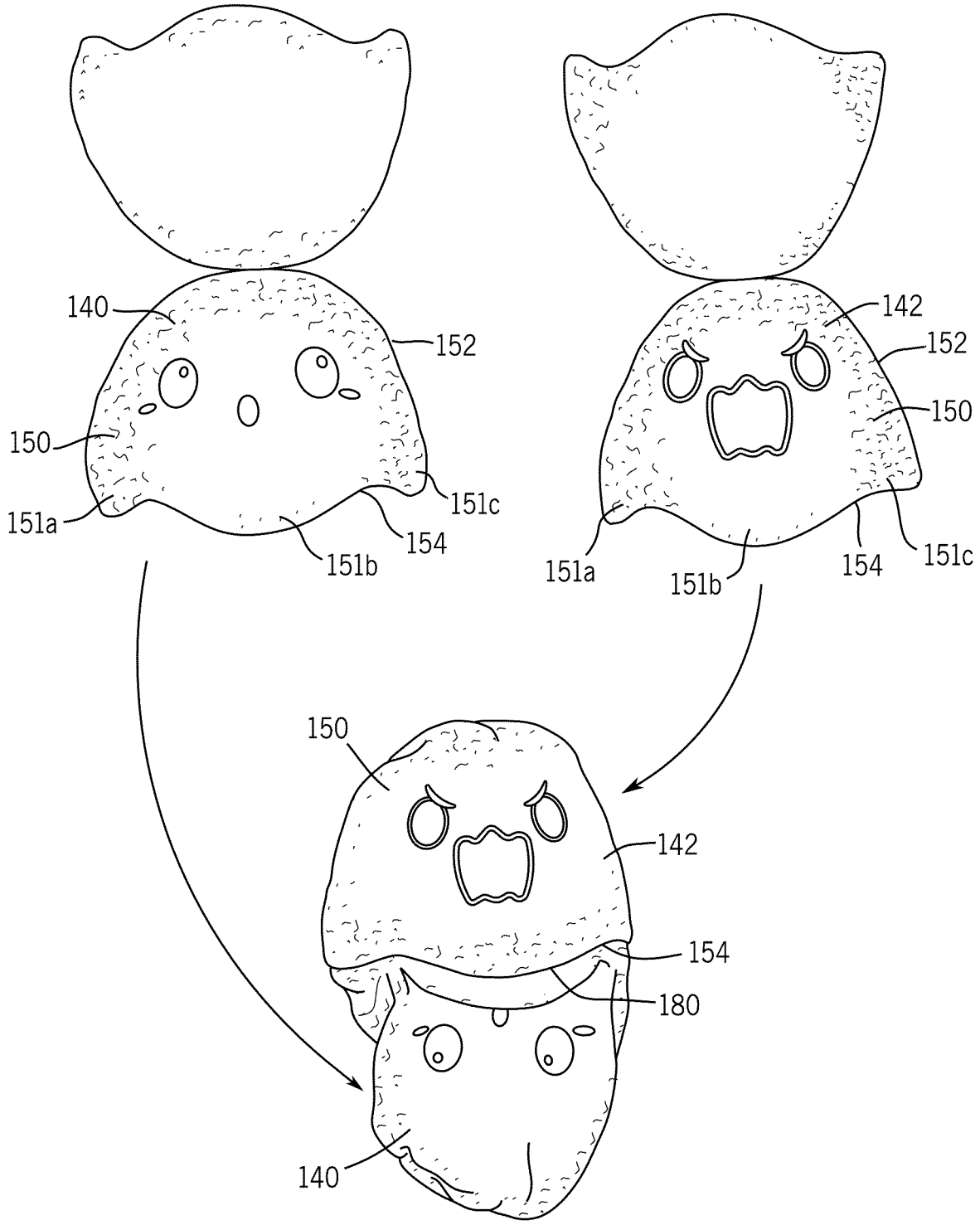
FIG. 20 is an exploded view of the body of the reversible toy of FIG. 16.
Figure 21:
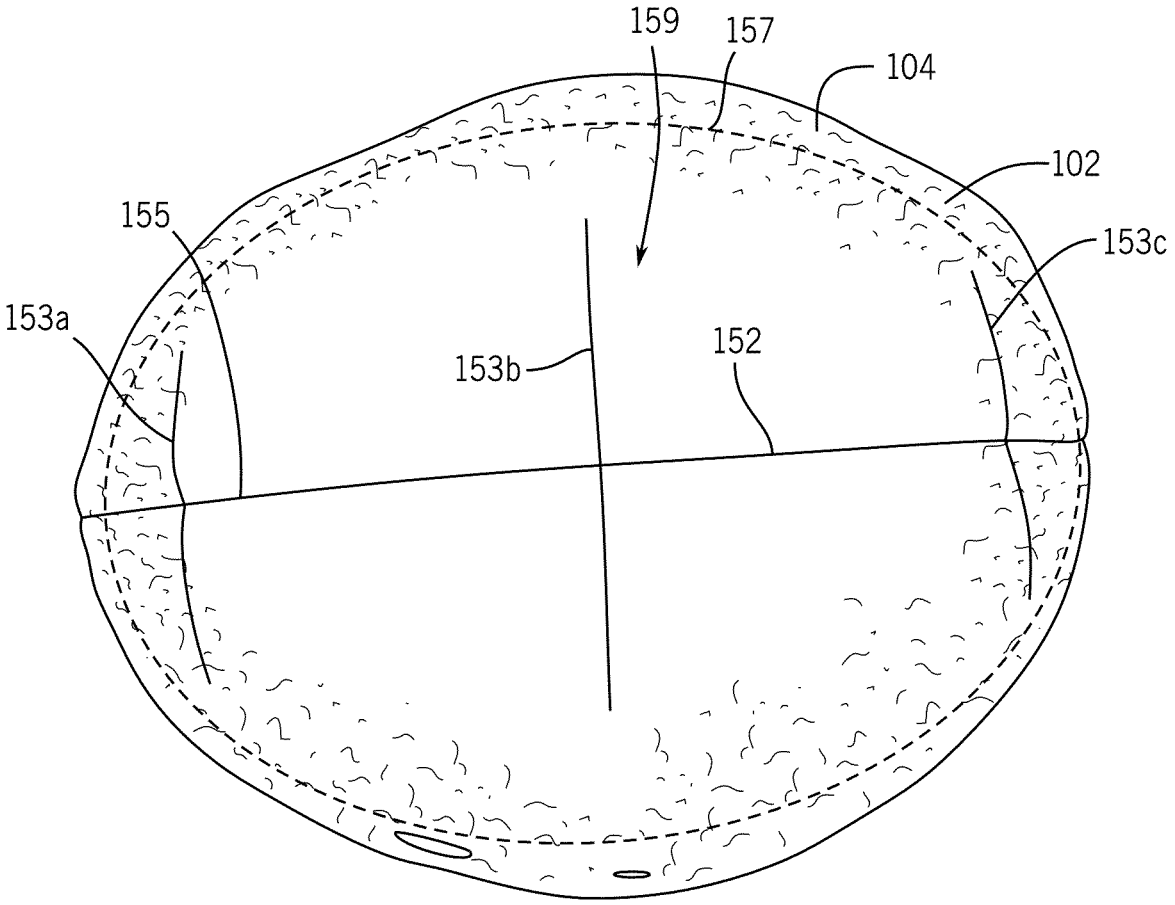
FIG. 21 is a top plan view of the body of the reversible toy of FIG. 16.
Figure 22:
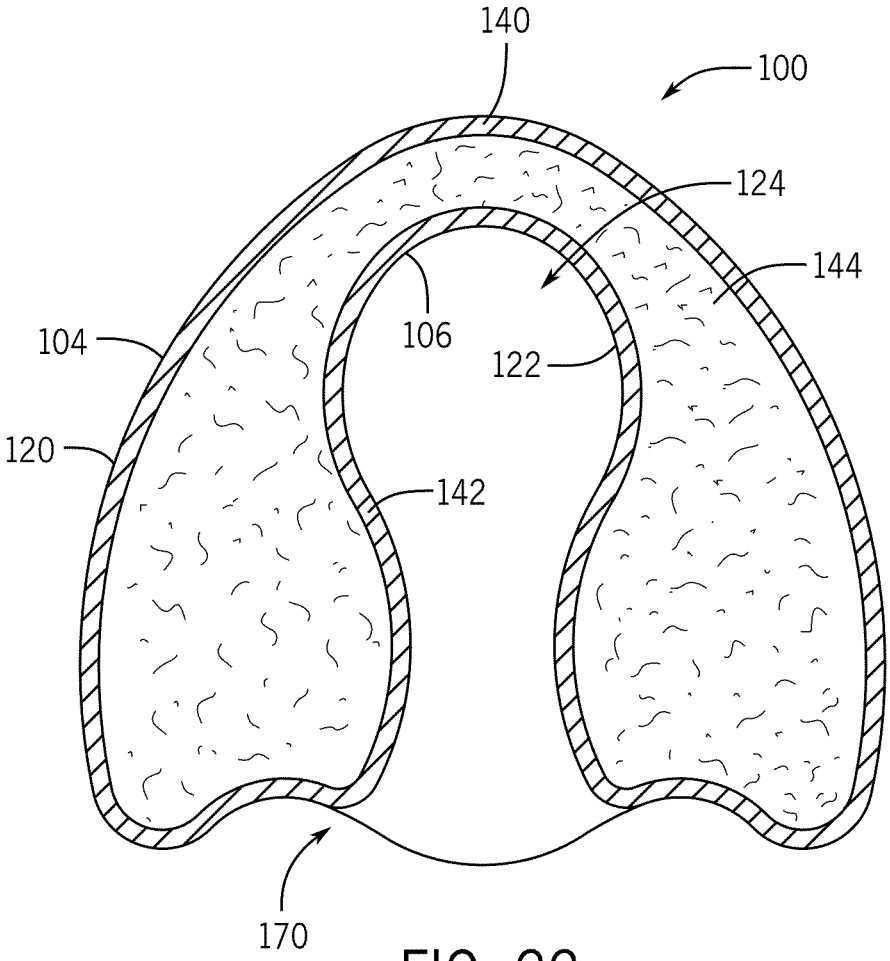
FIG. 22 is a cross-sectional view of the reversible toy of FIG. 16 in the first orientation and taken along line 22-22 of FIG. 16.

FIGS. 16-22 show another embodiment of a convertible or reversible toy 100 of the present disclosure. FIG. 16 is an isometric view of the reversible toy 100 in a first orientation. FIG. 17 is an isometric view of the reversible toy 100 in a second orientation. Referring to FIGS. 16 and 17, the reversible toy 100 includes a hollow body 102 defined by or including opposing first and second surfaces 104, 106, as discussed in more detail above with respect to FIGS. 1 and 2. The body 102 may have a top edge portion 159, a bottom edge portion 161, and a perimeter 157 defining an outer surface, as shown in FIGS. 16 and 21. The distance between the top edge portion 159 and bottom edge portion 161 may define a height. The perimeter 157 may have a length that varies along the height of the body 102. For example, the perimeter 157 length may taper along the height from the bottom edge portion 161 to the top edge portion 159. For example, the body 102 may form a bell shape.

As discussed, when the body 102 is in a first position, a first configuration or characteristic of the body 102 is presented, while when the body 102 is in a second position, a second configuration or characteristic of the body 102 is presented. In the depicted embodiment, when the body 102 is in a first position, as shown in FIG. 16, a friendly ghost with a white body 102 is presented. When the body 102 is in a second position, as shown in FIG. 17, a scary or angry ghost with a black body 102 is presented. Though illustrated as ghosts presenting different visible or physical characteristics between the first and second positions, in some embodiments, the first and second positions may be identical or substantially identical to each other or may vary in other ways. Further, the shape is not limited to a ghost but instead may be another aesthetic object, such as an animal, a cartoon character, a video game character, or the like.

FIG. 20 is an exploded view of the body 102 of the reversible toy 100. As shown in FIG. 20, the body 102 may include a first material layer 140 and a second material layer 142 similar to the layers 140, 142 discussed above with respect to FIG. 4. As discussed above, the body 102 may include fill material 144 positioned between the first and second material layers 140, 142 (see FIG. 22). The body 102 may include a plurality of sections or portions coupled together. In one embodiment, as shown in FIG. 20, each of the first and second material layers 140, 142 may include a plurality of body portions 150 coupled together. As shown in FIG. 20, each of the first and second material layers 140, 142 includes two body portions 150 coupled together. The body portions 150 may be arranged to provide a desired size and shape of the body 102 once the body portions 150 are coupled together. For example, the body portions 150 may be sized and shaped such that when coupled together the body portions 150 define a bell shape with an undulating bottom portion, though other shapes are contemplated including globoid, cylindrical, ellipsoid, etc.

As shown in FIG. 20, each body portion may include one or more side edges 152 and a terminal edge 154. As shown, the terminal edge 154 is undulating, forming a wave-like shape. In the depicted embodiment, the terminal edge 154 forms three waves or undulations 151*a-c*; however more or less waves or undulations are contemplated. In the depicted embodiment, at least portions of the one or more side edges 152 of one body portion 150 may be attached to the side edges 152 of an adjacent body portion 150, such as by a line of stitching 155 (see FIG. 21). As explained more fully above with respect to FIG. 4, the terminal edges 154 may be arranged to couple the first material layer 140 to the second material layer 142.

Figure 18:
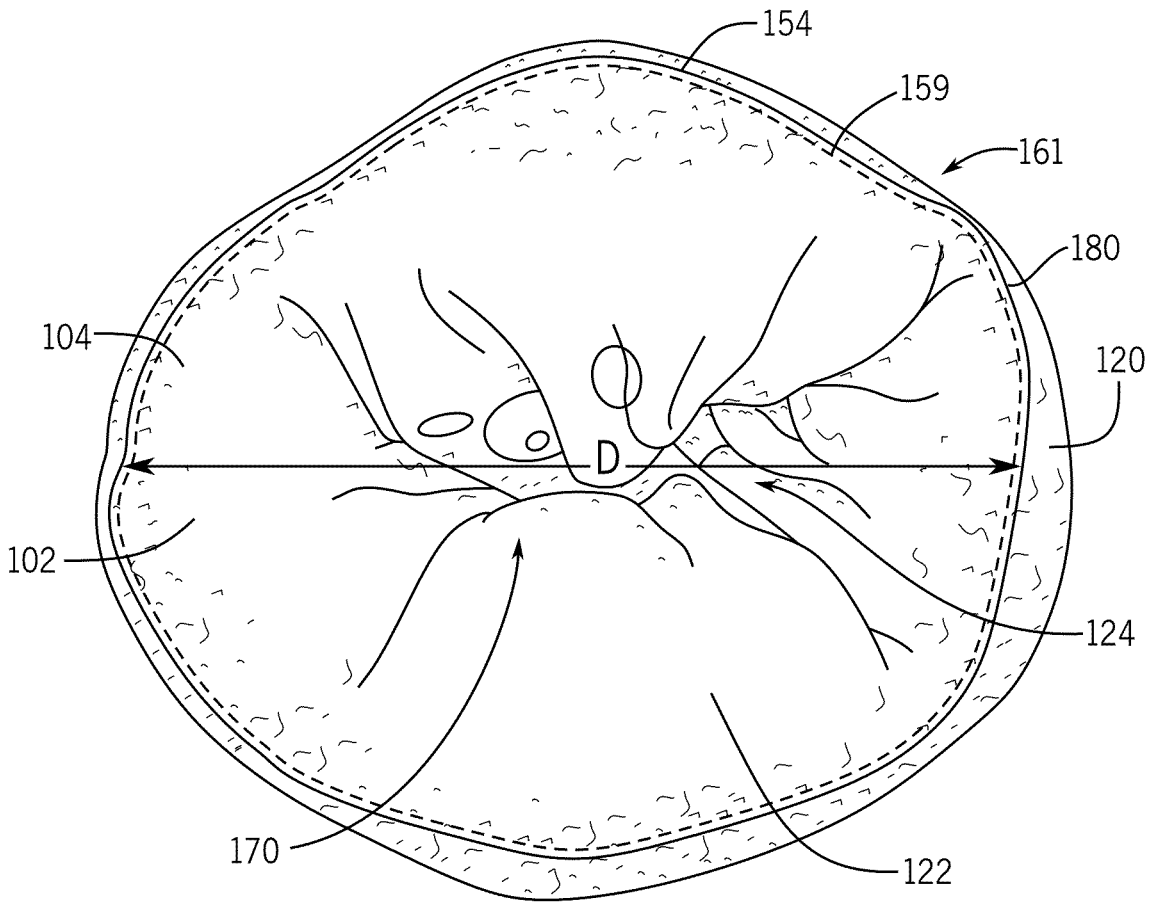
FIG. 18 is a bottom plan view of the reversible toy of FIG. 16 in a first or resting position.

In several embodiments, the retainer 180 may be defined by the coupling of the terminal edges 154. In several embodiments, the first material layer 140 and the second material layer 142 may be coupled only at the retainer 180. For example, the retainer 180 may be an edge, an interface, a line of stitching, a seam, or the like, and the retainer 180 may form the bottom edge of the body 102. The retainer may be undulating, forming a wave-like shape, a zig-zag shape, or a shape that may form an irregular shape having extra lengths that do not extend directly around the opening. For example, the retainer 180 may define an undulating bottom edge portion 161 of the body 102, having a sinusoidal or wave shape. In several embodiments, the shape of the retainer 180 may allow additional material along the bottom edge portion 161 of the body 102. For example, the retainer 180 may vary the height of the body 102 along the body 102 perimeter 157, e.g., the body includes tabs or protruding portions that extend into and out of the undulations of the perimeter edge. In several embodiments, the retainer 180 has a perimeter 159, as shown in FIG. 18, having a longer length than the length of the body 102 perimeter 157. The additional material and/or increased perimeter 159 length provide the retainer 180 with increased flexibility allowing the retainer 180 to deform as the body 102 transitions from a first position to a second position. For example, the retainer 180 is stretchable to flip the bottom edge portion 161 over the outer surface and push the body 102 through the opening 170.

FIG. 21 shows a top view of the body 102 of the reversible toy 100. As shown, the body 102 may include additional lines of stitching to provide additional flexibility to the body 102 when the body is 102 is moved between the first and second positions. As shown, the body 102 includes a plurality of lines of stitching 153*a-c* that traverse the line of stitching 155 that couples the body portions 150. In the depicted example, the body 102 includes three lines of stitching 153*a-c*; however, more or less lines of stitching are contemplated. In the depicted embodiment, the outer lines of stitching 153*a* and 153*c* are spaced equidistant from the central line of stitching 153*b*. The central line of stitching 153*b* has a longer length than the outer lines of stitching 153*a* and 153*c*; however the lines of stitching may all be the same length or the central line of stitching 153*b* may be shorter than the outer lines of stitching 153*a* and 153*c*.

FIGS. 18 and 19 show a bottom view of the reversible toy 100. As shown, the reversible toy 100 includes an opening 170 to the interior cavity 124. The opening 170 may be defined by the body 102, such as by the retainer 180 coupling the first material layer 140 to the second material layer 142. As described herein, at least portions of the body 102 collapse through the opening 170 when the body 102 is moved between the first and second positions. For example, at least portions of the first and second surfaces 104, 106 collapse through the opening 170 to alternatingly present one of the first and second surfaces 104, 106 as the outer body surface 120 and the other of the first and second surfaces 104, 106 as the stored body surface 122 within the interior cavity 124. The opening 170 may be expandable to facilitate collapsing of the first and second surfaces 104, 106 therethrough. For example, the bottom edge portion 161 of the body 102 (e.g., the retainer 180) may be flexible, stretchable, moldable, expandable, or repositionable to expand the opening 170. For example, the retainer 180 may be outwardly stretched (e.g., in a direction towards the exterior surface) and folded over the exterior surface to transition the reversible toy 100 to a new position (e.g., either the first or second position). The opening 170 may be resilient and may return to an original, resting position (e.g., as shown in FIG. 18) after the body 102 is pushed through the opening 170 to its new position (e.g., either the first or second position).

As shown in FIG. 18, the opening 170 includes a diameter D. The retainer 180 may define the diameter D across the opening. Depending on the lengths of the undulations 151*a-c*, the length of the diameter D may vary (e.g., the diameter D length may vary depending on the location where the diameter is measured across the opening). The diameter D dimension may be adjustable to allow collapsing of the first and second surfaces 104, 106 through the opening 170. For example, FIG. 19 shows the diameter D enlarging as the opening 170 is expanded by a user pulling on the opening 170 to push the body 102 through the opening 170 from the second position (e.g., as shown in FIG. 17) to the first position (e.g., as shown in FIG. 16). As shown, the diameter D enlarges when a separating force is applied to the bottom edge portion 161 of the body 102 (e.g., to the retainer 180). For example, the diameter D dimension may be increased to a size larger than a maximum diameter $D_{MAX}$ of the body 102. The undulations provide additional material that enables expansion of the opening 170 and enlargement of the diameter D.

Figure 23:
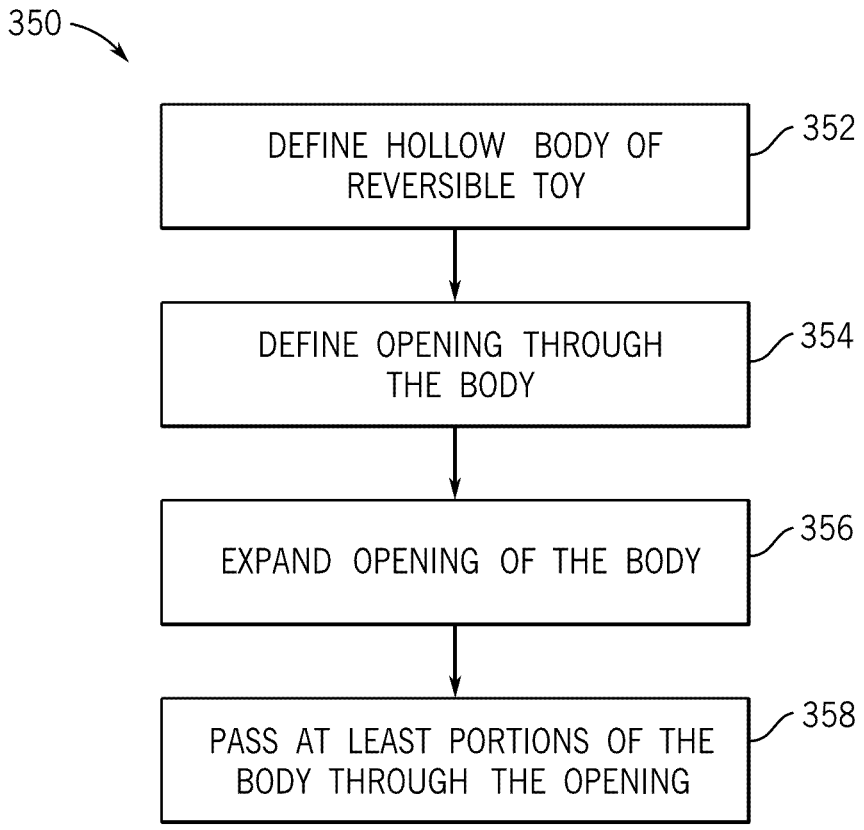
FIG. 23 is a flow chart illustrating a method of reversing a reversible toy according to another embodiment of the present disclosure.

FIG. 23 is a flow chart illustrating a method 350 of reversing a plush toy, such as reversible toy 100 of FIGS. 16-22. Referring to FIG. 23, the method 350 includes defining the body 102 of the reversible toy 100 (Block 352), defining the opening 170 through the body 102 (Block 354), expanding the opening 170 of the body 102 (Block 356), and passing at least portions of the body 102 through the opening 170 (Block 358). The body 102 may include first and second surfaces 104, 106. The opening 170 may be flexible and stretchable to expand the opening 170 diameter D to a size that is larger than a maximum diameter $D_{MAX}$ of the body 102. Passing portions of the body 102 through the opening 170 may alternatingly present the first surface 104 or the second surface 106 as an exterior of the body 102 (e.g., as the outer body surface 120). The other of the first surface 104 or the second surface 106 may be alternatingly collapsed within the body 102, such as within the interior cavity 124 of the body 102. In some embodiments, defining the body 102 may include attaching a plurality of body portions 150 (e.g., two body portions) together. Attachment of the plurality of body portions 150 may define the shape of the body 102. For example, attaching the body portions 150 together may define a bell-type shape to the body 102 with an undulating bottom edge portion 161 though other shapes are contemplated.

It should be noted that any of the features in the various examples and embodiments provided herein may be interchangeable and/or replaceable with any other example or embodiment. As such, the discussion of any component or element with respect to a particular example or embodiment is meant as illustrative only.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the present disclosure, and do not create limitations, particularly as to the position, orientation, or use of the present disclosure unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present disclosure is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present disclosure. It is intended that all matter contained in the above description or shown in the accompanying drawings shall be interpreted as illustrative only and not limiting. Changes in detail or structure may be made without departing from the spirit of the present disclosure as defined in the appended claims.

What is claimed is:

1. A reversible toy comprising:

a body including first and second material layers coupled by a retainer, wherein the body defines an opening to an interior cavity, the interior cavity having a closed top end positioned opposite the opening;

the body is reversible between a first position and a second position by collapsing at least a portion of the body through the opening;

in the first position, the first material layer forms an outer surface of the reversible toy and the second material layer forms an inner surface of the reversible toy, wherein the inner surface defines the interior cavity and the closed top end;

in the second position, the second material layer forms the outer surface of the reversible toy and the first material layer forms the inner surface of the reversible toy and the closed top end; and the retainer couples the first and second material layers and defines an undulating terminal bottom edge of the body from the first and second material layers in both the first and second positions, the undulating terminal bottom edge defining a sinusoidal edge of the opening of the reversible toy when the body is in either the first position or the second position.

2. The reversible toy of claim 1, wherein the retainer defines the opening that remains open in both the first and second positions.

3. The reversible toy of claim 1, wherein a height is defined between the retainer and an uppermost point of the body and the height varies along a perimeter of the body.

4. The reversible toy of claim 1, wherein the body defines a perimeter and the retainer defines a perimeter of the opening, wherein a dimension of the retainer is greater than a dimension of the perimeter of the body.

5. The reversible toy of claim 1, wherein the retainer is sufficiently flexible to allow the opening to expand as the body switches between the first and second positions.

6. The reversible toy of claim 1, wherein a diameter of the opening is enlarged to a dimension larger than a maximum diameter of the body when the retainer is stretched to allow the body to transition from the first position to the second position.

7. The reversible toy of claim 1, wherein the body comprises a plurality of body portions coupled together to define a bell shape to the body.

8. The reversible toy of claim 7, wherein the plurality of body portions comprise an undulating terminal edge with two or more undulations.

9. The reversible toy of claim 1, wherein fill material is received within a sealed cavity defined between the first and second material layers to space the first and second material layers apart.

10. The reversible toy of claim 1, wherein the undulating bottom edge folds over the outer body surface as the body is moved between the first and second positions.

11. The reversible toy of claim 1, wherein the first material layer comprises two body portions coupled together by a first line of stitching and a plurality of lines of stitching that traverse the first line of stitching.

12. The reversible toy of claim 1, wherein the undulating terminal bottom edge has select lengths that extend up towards a top end of the body and select lengths that extend back down away from the top end.

13. The reversible toy of claim 12, wherein the select lengths that extend up towards the top and of the body and the select lengths that extend back down away from the top end impart flexibility to the retainer, allowing the retainer to be more easily stretched to increase the opening.

14. The reversible toy of claim 1, wherein the undulating terminal bottom edge provides the retainer with additional material, the additional material providing the retainer with increased flexibility to deform as the body transitions from the first position to the second position.

15. A reversible toy comprising:

a body including a first surface and a second surface opposing the first surface, wherein the body is reversible between first and second positions; and an opening to an interior cavity defined by the body and having a diameter adjustable between a first dimension and a second dimension when the body is moved between the first and second positions, wherein the first and second surfaces extend to the same position proximate the opening, and wherein the body defines a closed top end positioned opposite the opening;

wherein in the first position, the first surface defines an outer body surface and the second surface defines an inner body surface;

wherein in the second position, the second surface defines the outer body surface and the first surface defines the inner body surface;

wherein the body defines the same shape in both the first position and the second position; and wherein the opening is defined by a coupling of the first surface and the second surface to form an undulating terminal bottom edge of the body having a sinusoidal shape with a plurality of peaks and troughs, the peaks positioned closer to a top portion of the body than the troughs.

16. The reversible toy of claim 15, wherein the opening perimeter has a dimension larger than a dimension of a perimeter of the body.

17. The reversible toy of claim 15, wherein the second dimension is larger than a maximum diameter of the body.

18. A reversible toy, comprising:

a first body configuration comprising a first body outer surface defining a first body perimeter, a first body inner surface defining an interior cavity, and a first body undulating bottom edge varying in height along a perimeter of the first body undulating edge; and a second body configuration comprising a second body outer surface, wherein the second body outer surface is the first body inner surface and the second body outer surface defines a second body perimeter, a second body inner surface, wherein the second body inner surface is the first body outer surface and the second body inner surface defines the interior cavity, and a second body undulating bottom edge varying in height along a perimeter of the second body undulating bottom edge;

wherein the first body perimeter has the same dimensions as the second body perimeter;

wherein the first body undulating bottom edge and the second body undulating bottom edge are coupled to form the same undulating terminal bottom edge of the reversible toy along an opening to an interior cavity, the undulating terminal bottom edge having a sinusoidal shape;

wherein the reversible toy is transitioned from the first body configuration to the second body configuration at least in part by pushing the first body outer surface towards the first body inner surface.

19. The reversible toy of claim 18, wherein in the first body configuration, the first body inner surface is visible; and in the second body configuration, the second body inner surface is visible.

20. The reversible toy of claim 18, wherein the first body configuration and the second body configuration have the same shape.

* * * * *